US010940917B2

(12) United States Patent
Montague et al.

(10) Patent No.: US 10,940,917 B2
(45) **Date of Patent: *Mar. 9, 2021**

(54) WATERCRAFT DEVICE WITH HYDROFOIL AND ELECTRIC PROPELLER SYSTEM

(71) Applicant: Kai Concepts, LLC, Alameda, CA (US)

(72) Inventors: Donald Lewis Montague, Alameda, CA (US); Joseph Andrew Brock, Alameda, CA (US); Jamieson Edward Schulte, Alameda, CA (US); Daniel Elliot Schabb, Alameda, CA (US)

(73) Assignee: Kai Concepts, LLC, Alameda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/543,447

(22) Filed: Aug. 16, 2019

(65) Prior Publication Data

US 2019/0367132 A1 Dec. 5, 2019

Related U.S. Application Data

(63) Continuation of application No. 15/700,658, filed on Sep. 11, 2017.

(Continued)

(51) Int. Cl.
*B63B 1/24* (2020.01)
*B63H 21/21* (2006.01)

(Continued)

(52) U.S. Cl.
CPC ..... *B63B 1/246* (2013.01); *B63B 32/10* (2020.02); *B63B 32/60* (2020.02); *B63H 1/22* (2013.01);

(Continued)

(58) Field of Classification Search
CPC . B63B 1/246; B63B 35/7943; B63B 35/7923; B63H 21/17; B63H 1/22; B63H 21/213; B63H 5/07; B63H 2005/075
See application file for complete search history.

(56) References Cited

U.S. PATENT DOCUMENTS 1,067,392 A 7/1913 Barr
3,405,677 A 10/1968 Smith (Continued)

FOREIGN PATENT DOCUMENTS

AU 5012101 A 12/2002
AU 2004100571 A4 8/2004

(Continued)

OTHER PUBLICATIONS

Evolo Final Report, Apr. 23, 2009.

*Primary Examiner* — Anthony D Wiest
(74) *Attorney, Agent, or Firm* — Wolf IP Law PLLC; Dean E. Wolf, Esq.

(57) ABSTRACT

A modular, weight-shift controlled watercraft device is disclosed which includes: a modular board removably attachable to a power system. The power system includes a modular power supply system, and a modular propulsion system. The power supply system includes a housing including a battery. The propulsion system includes a modular strut, a modular propulsion pod, and a modular hydrofoil. In one embodiment, the power supply system is removably and mechanically attachable directly to the propulsion system.

17 Claims, 19 Drawing Sheets

Related U.S. Application Data

(60) Provisional application No. 62/393,580, filed on Sep. 12, 2016.

(51) Int. Cl.

| | |
|---|---|
| ***B63H 1/22*** | (2006.01) |
| ***B63H 21/17*** | (2006.01) |
| ***B63H 5/07*** | (2006.01) |
| ***B63B 32/60*** | (2020.01) |
| ***B63B 32/10*** | (2020.01) |

(52) U.S. Cl.
CPC ..... *B63H 5/07* (2013.01); *B63H 21/17* (2013.01); *B63H 21/213* (2013.01); *B63H 2005/075* (2013.01)

(56) References Cited

U.S. PATENT DOCUMENTS 3,704,442 A * 11/1972 Wright ..... G01G 23/28 367/96
3,804,048 A * 4/1974 Cline ..... B63B 1/283 114/281
3,902,444 A * 9/1975 Stark ..... B63B 1/286 114/275
4,056,074 A 11/1977 Sachs
4,517,912 A 5/1985 Jones
5,062,378 A 11/1991 Bateman
5,178,089 A 1/1993 Hodel
5,309,859 A 5/1994 Miller
5,429,562 A 7/1995 Milner
5,809,926 A 9/1998 Kelsey
5,848,922 A 12/1998 Itima et al.
6,095,076 A 8/2000 Nesbitt
6,142,840 A 11/2000 Efthymiou
6,178,905 B1 1/2001 Dynes et al.
6,183,333 B1 2/2001 Hall
6,192,817 B1 2/2001 Dec et al.
6,311,631 B1 11/2001 Beecher
6,371,726 B1 * 4/2002 Jonsson ..... B63H 1/24 416/131
6,409,560 B1 6/2002 Austin
6,475,045 B2 11/2002 Schultz et al.
6,568,340 B2 5/2003 Dec et al.
6,578,506 B2 6/2003 Bieker
6,591,776 B2 7/2003 Miyazaki
6,702,634 B2 3/2004 Jung
6,743,064 B2 6/2004 Gieseke
6,901,872 B1 6/2005 Battle et al.
6,902,446 B1 * 6/2005 Healey ..... H02K 23/66 114/144 E
6,966,808 B1 11/2005 Liao
7,047,901 B2 5/2006 Chen
7,089,875 B2 8/2006 Kurze
7,097,523 B2 8/2006 Woolley
7,138,774 B2 11/2006 Negoro et al.
7,143,710 B2 12/2006 Lang et al.
7,166,005 B2 1/2007 Tirloni et al.
7,182,036 B2 2/2007 Levine
7,182,037 B2 2/2007 Otobe et al.
7,226,329 B2 6/2007 Railey
7,243,607 B2 7/2007 Chesney et al.
7,275,493 B1 10/2007 Brass
7,298,056 B2 11/2007 Gizara
7,506,600 B2 3/2009 Furuya et al.
7,601,041 B2 10/2009 McCarthy
7,731,555 B2 6/2010 Railey
7,980,191 B2 7/2011 Murphy
7,993,178 B2 8/2011 Railey
8,043,135 B1 10/2011 Corn
8,070,544 B2 12/2011 Roman
8,123,578 B2 2/2012 Mewis
8,166,905 B2 5/2012 Gratsch
8,262,425 B1 9/2012 Jones
8,290,636 B2 10/2012 Manning
8,312,831 B2 11/2012 Templeman et al.
8,398,446 B2 3/2013 Railey et al.
8,456,310 B2 6/2013 Becker
8,636,552 B2 1/2014 Braden et al.
8,702,458 B2 4/2014 Preston
8,851,947 B2 10/2014 Vlock et al.
8,863,681 B2 10/2014 Howes et al.
8,870,614 B2 10/2014 Railey
8,951,079 B2 2/2015 Railey et al.
9,056,654 B1 6/2015 Fraser
9,120,547 B2 9/2015 Vlock et al.
9,162,741 B2 10/2015 Kohnsen
9,359,044 B2 6/2016 Langelaan
9,475,559 B2 10/2016 Czarnowski et al.
9,573,656 B2 2/2017 Templeman
9,586,659 B2 3/2017 Langelaan
9,643,694 B2 5/2017 Geislinger et al.
9,669,902 B2 6/2017 Geisiinger
9,701,372 B2 7/2017 Railey
9,718,521 B2 8/2017 Derrah
9,718,528 B2 8/2017 Railey et al.
9,758,962 B2 9/2017 Geislinger et al.
9,789,935 B1 10/2017 Aguera
9,789,943 B2 10/2017 Lehmann
9,645,138 B2 12/2017 Kohnsen
9,835,224 B2 12/2017 Geislinger et al.
10,029,775 B2 7/2018 Nikmanesh
10,099,754 B2 10/2018 Tian
D843,303 S * 3/2019 Leason ..... D12/309
10,227,120 B2 3/2019 Ajello
10,235,870 B2 3/2019 Leason et al.
10,266,239 B2 4/2019 Fry
10,279,873 B2 5/2019 Logosz
D852,112 S 6/2019 Leason et al.
10,308,336 B1 6/2019 Vermeulen
D853,310 S 7/2019 Leason et al.
10,358,194 B1 7/2019 Wengreen et al.
D857,606 S 8/2019 Dane
D866,872 S 11/2019 Liu
10,486,771 B2 11/2019 Tian
10,526,057 B2 1/2020 Kohnsen
10,532,797 B2 1/2020 Derrah
10,597,118 B2 3/2020 Montague et al.
10,597,123 B2 3/2020 Bell
D882,010 S 4/2020 Vermillion
10,618,621 B1 4/2020 Rott et al.
10,625,834 B2 4/2020 MacFarlane
D883,177 S 5/2020 Leason et al.
10,647,387 B2 5/2020 Dombois
10,647,392 B2 5/2020 Trewern
10,668,987 B1 6/2020 Murphy
10,668,994 B2 6/2020 Frank
10,683,075 B2 6/2020 Schibli
10,759,503 B2 9/2020 Aguera
2001/0042498 A1 11/2001 Burnham
2003/0089293 A1 5/2003 Vos
2003/0167991 A1 9/2003 Namanny
2004/0139905 A1 * 7/2004 Chen ..... B63B 1/246 114/274
2005/0266746 A1 12/2005 Murphy
2006/0249513 A1 11/2006 Duke
2008/0168937 A1 7/2008 Ruan et al.
2008/0243321 A1 10/2008 Walser et al.
2008/0268730 A1 10/2008 Heesterman
2011/0014829 A1 † 1/2011 Burke
2011/0056423 A1 3/2011 Railey
2011/0201238 A1 8/2011 Rott et al.
2011/0256518 A1 10/2011 Rott
2012/0000409 A1 1/2012 Railey
2012/0126972 A1 5/2012 Rott et al.
2013/0029547 A1 1/2013 Suzuki
2013/0157526 A1 6/2013 Martin
2014/0053764 A1 2/2014 Ruan et al.
2015/0064995 A1 3/2015 Woods et al.
2015/0001189 A1 4/2015 Kohnsen
2015/0118923 A1 4/2015 Kohnsen
2016/0185430 A1 * 6/2016 Langelaan ..... B63H 21/17 440/6
2016/0002076 A1 7/2016 Kohnsen

(56) References Cited

U.S. PATENT DOCUMENTS

| | | | |
|---|---|---|---|
| 2016/0207601 | A1 | 7/2016 | Kohnsen |
| 2018/0099730 | A1 | 4/2018 | Riegerbauer |
| 2018/0118311 | A1 | 5/2018 | Kohnsen |
| 2018/0370600 | A1 | 12/2018 | Geislinger |
| 2019/0061557 | A1 | 2/2019 | Quick et al. |
| 2019/0061880 | A1 | 2/2019 | Bousquet |
| 2019/0168850 | A1 | 6/2019 | Tian |
| 2019/0168851 | A1 | 6/2019 | Tian |
| 2019/0173138 | A1 | 6/2019 | Tian |
| 2019/0233063 | A1 | 8/2019 | Geislinger |
| 2019/0233076 | A1 | 8/2019 | Aldama |
| 2019/0344662 | A1 | 11/2019 | Tian |
| 2019/0389551 | A1 | 12/2019 | Aoki et al. |
| 2020/0018969 | A1 | 1/2020 | Ou et al. |
| 2020/0047849 | A1 | 2/2020 | Claughton et al. |
| 2020/0079479 | A1 | 3/2020 | Derrah |
| 2020/0102052 | A1 | 4/2020 | Geislinger et al. |
| 2020/0001400 | A1 | 5/2020 | Kohnsen |
| 2020/0140042 | A1 | 5/2020 | Kohnsen |
| 2020/0172206 | A1 | 6/2020 | Terada |
| 2020/0172207 | A1 | 6/2020 | Wengreen et al. |
| 2020/0172213 | A1 | 6/2020 | Rodriguez Rondon et al. |
| 2020/0231264 | A1 | 7/2020 | Imai |
| 2020/0283102 | A1 | 9/2020 | Lind et al. |

FOREIGN PATENT DOCUMENTS

| | | | |
|---|---|---|---|
| AU | 2004215331 | A1 | 9/2004 |
| AU | 2007100530 | A4 | 9/2007 |
| AU | 2007202451 | A9 | 8/2008 |
| AU | 2007202855 | A1 | 1/2009 |
| AU | 2011203287 | A1 | 1/2012 |
| AU | 2010312322 | A1 | 4/2012 |
| AU | 2013100044 | A4 | 2/2013 |
| AU | 2013290356 | A1 | 2/2015 |
| AU | 2018203516 | A1 | 1/2019 |
| AU | 2018390893 | A1 | 7/2020 |
| BR | 8201283 | U | 3/2004 |
| BR | 102013022366 | A2 | 8/2015 |
| CN | 2675546 | Y | 2/2005 |
| CN | 2875944 | Y | 3/2007 |
| CN | 101012003 | A | 8/2007 |
| CN | 201012743 | Y | 1/2008 |
| CN | 201012744 | Y | 1/2008 |
| CN | 201023637 | Y | 2/2008 |
| CN | 201086813 | Y | 7/2008 |
| CN | 201220740 | Y | 4/2009 |
| CN | 201291996 | Y | 8/2009 |
| CN | 201300970 | Y | 9/2009 |
| CN | 201300971 | Y | 9/2009 |
| CN | 201329950 | Y | 10/2009 |
| CN | 201331716 | Y | 10/2009 |
| CN | 201347194 | Y | 11/2009 |
| CN | 201390374 | Y | 1/2010 |
| CN | 201406017 | Y | 2/2010 |
| CN | 201406019 | Y | 2/2010 |
| CN | 201406020 | Y | 2/2010 |
| CN | 201407093 | Y | 2/2010 |
| CN | 201407094 | Y | 2/2010 |
| CN | 201415754 | Y | 3/2010 |
| CN | 201437400 | U | 4/2010 |
| CN | 201447051 | U | 5/2010 |
| CN | 101734354 | A | 6/2010 |
| CN | 101734355 | A | 6/2010 |
| CN | 101734356 | A | 6/2010 |
| CN | 101746490 | A | 6/2010 |
| CN | 101870343 | A | 10/2010 |
| CN | 101870344 | A | 10/2010 |
| CN | 101870346 | A | 10/2010 |
| CN | 101871382 | A | 10/2010 |
| CN | 101927817 | A | 12/2010 |
| CN | 201914426 | U | 8/2011 |
| CN | 202264871 | U | 6/2012 |
| CN | 202574577 | U | 12/2012 |
| CN | 202574578 | U | 12/2012 |
| CN | 101875396 | B | 9/2013 |
| CN | 103373451 | A | 10/2013 |
| CN | 103373453 | A | 10/2013 |
| CN | 103419908 | A | 12/2013 |
| CN | 203381780 | U | 1/2014 |
| CN | 203567910 | U | 4/2014 |
| CN | 203593146 | U | 5/2014 |
| CN | 101879934 | B | 9/2014 |
| CN | 104229063 | A | 12/2014 |
| CN | 104229088 | A | 12/2014 |
| CN | 204056245 | U | 12/2014 |
| CN | 104260845 | A | 1/2015 |
| CN | 104260869 | A | 1/2015 |
| CN | 104295419 | A | 1/2015 |
| CN | 204124333 | U | 1/2015 |
| CN | 204197224 | U | 3/2015 |
| CN | 204197225 | U | 3/2015 |
| CN | 204197244 | U | 3/2015 |
| CN | 204197245 | U | 3/2015 |
| CN | 204197246 | U | 3/2015 |
| CN | 204197248 | U | 3/2015 |
| CN | 204197257 | U | 3/2015 |
| CN | 204197259 | U | 3/2015 |
| CN | 204197260 | U | 3/2015 |
| CN | 204197261 | U | 3/2015 |
| CN | 204200363 | U | 3/2015 |
| CN | 204200365 | U | 3/2015 |
| CN | 204200366 | U | 3/2015 |
| CN | 204200367 | U | 3/2015 |
| CN | 204200423 | U | 3/2015 |
| CN | 204200424 | U | 3/2015 |
| CN | 204200433 | U | 3/2015 |
| CN | 204200443 | U | 3/2015 |
| CN | 204436577 | U | 7/2015 |
| CN | 204659986 | U | 9/2015 |
| CN | 103661833 | B | 3/2016 |
| CN | 205131588 | U | 4/2016 |
| CN | 105691563 | A | 6/2016 |
| CN | 205418042 | U | 8/2016 |
| CN | 205469703 | U | 8/2016 |
| CN | 205469704 | U | 8/2016 |
| CN | 104309792 | B | 9/2016 |
| CN | 105947135 | A | 9/2016 |
| CN | 105966562 | A | 9/2016 |
| CN | 105966563 | A | 9/2016 |
| CN | 105966564 | A | 9/2016 |
| CN | 105966565 | A | 9/2016 |
| CN | 106005300 | A | 10/2016 |
| CN | 106054707 | A | 10/2016 |
| CN | 205632952 | U | 10/2016 |
| CN | 106081001 | A | 11/2016 |
| CN | 205675195 | U | 11/2016 |
| CN | 206054103 | U | 3/2017 |
| CN | 104228695 | B | 4/2017 |
| CN | 206087218 | U | 4/2017 |
| CN | 106846757 | A | 6/2017 |
| CN | 206297715 | U | 7/2017 |
| CN | 206317993 | U | 7/2017 |
| CN | 206446772 | U | 8/2017 |
| CN | 206466156 | U | 9/2017 |
| CN | 206466161 | U | 9/2017 |
| CN | 206466166 | U | 9/2017 |
| CN | 206466174 | U | 9/2017 |
| CN | 206466180 | U | 9/2017 |
| CN | 206466191 | U | 9/2017 |
| CN | 206471439 | U | 9/2017 |
| CN | 206471884 | U | 9/2017 |
| CN | 206606355 | U | 11/2017 |
| CN | 105923116 | B | 1/2018 |
| CN | 107628209 | A | 1/2018 |
| CN | 206914584 | U | 1/2018 |
| CN | 206984297 | U | 2/2018 |
| CN | 207010363 | U | 2/2018 |
| CN | 107776839 | A | 3/2018 |
| CN | 207129115 | U | 3/2018 |
| CN | 107953977 | A | 4/2018 |
| CN | 207257921 | U | 4/2018 |
| CN | 207389479 | U | 5/2018 |
| CN | 207389513 | U | 5/2018 |

(56) References Cited

FOREIGN PATENT DOCUMENTS

| | | | |
|---|---|---|---|
| CN | 108189978 | A | 6/2018 |
| CN | 207450184 | U | 6/2018 |
| CN | 207496901 | U | 6/2018 |
| CN | 207496902 | U | 6/2018 |
| CN | 207510694 | U | 6/2018 |
| CN | 207550443 | U | 6/2018 |
| CN | 207550444 | U | 6/2018 |
| CN | 207670628 | U | 7/2018 |
| CN | 108357650 | A | 8/2018 |
| CN | 207683736 | U | 8/2018 |
| CN | 207683737 | U | 8/2018 |
| CN | 104260846 | B | 9/2018 |
| CN | 108482604 | A | 9/2018 |
| CN | 108583797 | A | 9/2018 |
| CN | 207851575 | U | 9/2018 |
| CN | 108609124 | A | 10/2018 |
| CN | 108725709 | A | 11/2018 |
| CN | 108909963 | A | 11/2018 |
| CN | 208134578 | U | 11/2018 |
| CN | 208165225 | U | 11/2018 |
| CN | 108945331 | A | 12/2018 |
| CN | 108974272 | A | 12/2018 |
| CN | 108974298 | A | 12/2018 |
| CN | 208291439 | U | 12/2018 |
| CN | 109131766 | A | 1/2019 |
| CN | 109263823 | A | 1/2019 |
| CN | 208344507 | U | 1/2019 |
| CN | 109334888 | A | 2/2019 |
| CN | 109334889 | A | 2/2019 |
| CN | 109334890 | A | 2/2019 |
| CN | 208498755 | U | 2/2019 |
| CN | 107215436 | B | 3/2019 |
| CN | 208616170 | U | 3/2019 |
| CN | 208630821 | U | 3/2019 |
| CN | 109572954 | A | 4/2019 |
| CN | 109625200 | A | 4/2019 |
| CN | 208715417 | U | 4/2019 |
| CN | 208715431 | U | 4/2019 |
| CN | 208715437 | U | 4/2019 |
| CN | 208715455 | U | 4/2019 |
| CN | 208760858 | U | 4/2019 |
| CN | 208760859 | U | 4/2019 |
| CN | 208760860 | U | 4/2019 |
| CN | 208760861 | U | 4/2019 |
| CN | 208760862 | U | 4/2019 |
| CN | 208781922 | U | 4/2019 |
| CN | 208789898 | U | 4/2019 |
| CN | 109774891 | A | 5/2019 |
| CN | 109795610 | A | 5/2019 |
| CN | 208855842 | U | 5/2019 |
| CN | 208915389 | U | 5/2019 |
| CN | 109850090 | A | 6/2019 |
| CN | 109895964 | A | 6/2019 |
| CN | 208931601 | U | 6/2019 |
| CN | 208931604 | U | 6/2019 |
| CN | 208931605 | U | 6/2019 |
| CN | 208931617 | U | 6/2019 |
| CN | 209000208 | U | 6/2019 |
| CN | 110039578 | A | 7/2019 |
| CN | 209159955 | U | 7/2019 |
| CN | 209176872 | U | 7/2019 |
| CN | 110085788 | A | 8/2019 |
| CN | 110171092 | A | 8/2019 |
| CN | 110182331 | A | 8/2019 |
| CN | 209253549 | U | 8/2019 |
| CN | 209258326 | U | 8/2019 |
| CN | 209258351 | U | 8/2019 |
| CN | 209258352 | U | 8/2019 |
| CN | 209290629 | U | 8/2019 |
| CN | 107128454 | B | 9/2019 |
| CN | 107933845 | B | 9/2019 |
| CN | 110239687 | A | 9/2019 |
| CN | 209366402 | U | 9/2019 |
| CN | 209366403 | U | 9/2019 |
| CN | 209366404 | U | 9/2019 |
| CN | 209366405 | U | 9/2019 |
| CN | 209366406 | U | 9/2019 |
| CN | 209366407 | U | 9/2019 |
| CN | 209366408 | U | 9/2019 |
| CN | 209369930 | U | 9/2019 |
| CN | 209385232 | U | 9/2019 |
| CN | 209441573 | U | 9/2019 |
| CN | 110350341 | A | 10/2019 |
| CN | 110356524 | A | 10/2019 |
| CN | 110362080 | A | 10/2019 |
| CN | 209454955 | U | 10/2019 |
| CN | 209479921 | U | 10/2019 |
| CN | 110406642 | A | 11/2019 |
| CN | 110481728 | A | 11/2019 |
| CN | 209581796 | U | 11/2019 |
| CN | 209581797 | U | 11/2019 |
| CN | 209581798 | U | 11/2019 |
| CN | 209600753 | U | 11/2019 |
| CN | 110562408 | A | 12/2019 |
| CN | 209739293 | U | 12/2019 |
| CN | 209766523 | U | 12/2019 |
| CN | 209833934 | U | 12/2019 |
| CN | 209833939 | U | 12/2019 |
| CN | 108407991 | B | 1/2020 |
| CN | 110683005 | A | 1/2020 |
| CN | 209913096 | U | 1/2020 |
| CN | 209921564 | U | 1/2020 |
| CN | 209921565 | U | 1/2020 |
| CN | 209938884 | U | 1/2020 |
| CN | 110816758 | A | 2/2020 |
| CN | 110844006 | A | 2/2020 |
| CN | 210068712 | U | 2/2020 |
| CN | 110911888 | A | 3/2020 |
| CN | 110920812 | A | 3/2020 |
| CN | 110920813 | A | 3/2020 |
| CN | 110920847 | A | 3/2020 |
| CN | 210149516 | U | 3/2020 |
| CN | 210149517 | U | 3/2020 |
| CN | 210212690 | U | 3/2020 |
| CN | 210212691 | U | 3/2020 |
| CN | 110949620 | A | 4/2020 |
| CN | 210310790 | U | 4/2020 |
| CN | 210364284 | U | 4/2020 |
| CN | 210364287 | U | 4/2020 |
| CN | 210478964 | U | 5/2020 |
| CN | 210478965 | U | 5/2020 |
| CN | 210478967 | U | 5/2020 |
| CN | 210503084 | U | 5/2020 |
| CN | 210526789 | U | 5/2020 |
| CN | 110901869 | B | 6/2020 |
| CN | 111268038 | A | 6/2020 |
| CN | 111284636 | A | 6/2020 |
| CN | 210806779 | U | 6/2020 |
| CN | 210852818 | U | 6/2020 |
| CN | 210971446 | U | 7/2020 |
| CN | 211018557 | U | 7/2020 |
| CN | 211126279 | U | 7/2020 |
| CN | 211139588 | U | 7/2020 |
| CN | 211336359 | U | 8/2020 |
| CN | 211364859 | U | 8/2020 |
| DE | 202006000210 | U1 | 3/2006 |
| DE | 202007003106 | U1 | 7/2007 |
| DE | 202010000559 | U1 | 6/2010 |
| DE | 102010032014 | A1 | 1/2012 |
| DE | 202013007100 | U1 | 9/2013 |
| DE | 202014006552 | U1 | 11/2014 |
| DE | 202017107819 | U1 | 1/2018 |
| DE | 202017107820 | U1 | 1/2018 |
| DE | 202017107821 | U1 | 1/2018 |
| DE | 202017107824 | U1 | 1/2018 |
| DE | 202017107826 | U1 | 1/2018 |
| DE | 102018113137 | A1 | 2/2019 |
| DE | 102017130946 | A1 | 6/2019 |
| DE | 102017130949 | A1 | 6/2019 |
| DE | 102017130955 | A1 | 6/2019 |
| DE | 102017130959 | A1 | 6/2019 |
| DE | 102017130963 | A1 | 6/2019 |
| DE | 102017130966 | A1 | 6/2019 |
| DE | 102018100696 | A1 | 6/2019 |

(56) References Cited

FOREIGN PATENT DOCUMENTS

| | | | |
|---|---|---|---|
| DE | 202019103496 | U1 | 9/2019 |
| DE | 202018104741 | U1 | 11/2019 |
| DE | 102018215176 | A1 | 3/2020 |
| DE | 102018127650 | A1 | 5/2020 |
| EP | 3041735 | A1 | 7/2016 |
| EP | 3526112 | A1 | 8/2019 |
| EP | 3526113 | A1 | 8/2019 |
| EP | 3529142 | A1 | 8/2019 |
| EP | 3529143 | A1 | 8/2019 |
| EP | 3552947 | A1 | 10/2019 |
| EP | 3277574 | B1 | 11/2019 |
| EP | 3640882 | A1 | 4/2020 |
| ES | 1153639 | Y | 7/2016 |
| FR | 3078680 | B1 | 5/2020 |
| GB | 2580022 | A | 7/2020 |
| HK | 1250973 | A1 | 1/2019 |
| IN | 200701396 12 | | 7/2008 |
| JP | 2002154479 | A | 5/2002 |
| JP | 2002193185 | A | 7/2002 |
| JP | 2008189169 | A | 8/2008 |
| JP | 2008230315 | A | 10/2008 |
| JP | 2009018702 | A | 1/2009 |
| JP | 2010173405 | A | 8/2010 |
| JP | 3163820 | U | 11/2010 |
| JP | 3183445 | U | 5/2013 |
| JP | 5221737 | B2 | 6/2013 |
| JP | 2014043150 | A | 3/2014 |
| JP | 5791376 | B2 | 10/2015 |
| JP | 2020111331 | A | 7/2020 |
| KR | 100560702 | B1 | 3/2006 |
| KR | 100572804 | B1 | 4/2006 |
| KR | 100581491 | B1 | 5/2006 |
| KR | 20090006619 | A | 1/2009 |
| KR | 20090098306 | A | 9/2009 |
| KR | 20100010874 | U | 11/2010 |
| KR | 101024595 | B1 | 3/2011 |
| KR | 200454353 | Y1 | 6/2011 |
| KR | 101491661 | B1 | 2/2015 |
| KR | 20160027555 | A | 3/2016 |
| KR | 20160057060 | A | 5/2016 |
| KR | 101697338 | B1 | 1/2017 |
| KR | 101713936 | B1 | 3/2017 |
| KR | 101767476 | B1 | 8/2017 |
| KR | 101857099 | B1 | 5/2018 |
| KR | 20190063727 | A | 6/2019 |
| KR | 101978043 | B1 | 8/2019 |
| KR | 102052195 | B1 | 12/2019 |
| KR | 102050718 | B1 | 1/2020 |
| KR | 200490972 | Y1 | 1/2020 |
| KR | 102095292 | B1 | 3/2020 |
| KR | 102095294 | B1 | 3/2020 |
| KR | 102103228 | B1 | 4/2020 |
| KR | 102103229 | B1 | 4/2020 |
| KR | 102116532 | B1 | 6/2020 |
| KR | 102133778 | B1 | 7/2020 |
| NO | 20181547 | A1 | 6/2020 |
| PL | 3277574 | T3 | 6/2020 |
| TW | M257328 | U | 2/2005 |
| TW | M308901 | U | 4/2007 |
| TW | 200848320 | A | 12/2008 |
| TW | 201000361 | A | 1/2010 |
| TW | I334793 | B | 12/2010 |
| TW | M461592 | U | 9/2013 |
| TW | I605324 | B | 11/2017 |
| TW | M552465 | U | 12/2017 |
| WO | 2002092420 | A1 | 11/2002 |
| WO | 2005058685 | A1 | 6/2005 |
| WO | 2006014085 | A1 | 2/2006 |
| WO | 2006042359 | A1 | 4/2006 |
| WO | 2007072185 | A2 | 6/2007 |
| WO | 2009144400 | A2 | 12/2009 |
| WO | 2011047431 | A1 | 4/2011 |
| WO | 2012013770 | A2 | 2/2012 |
| WO | 2013026714 | A1 | 2/2013 |
| WO | 2015039970 | A1 | 3/2015 |
| WO | 2016003121 | A1 | 1/2016 |
| WO | 2017069322 | A1 | 4/2017 |
| WO | 2017153338 | A1 | 9/2017 |
| WO | 2017221233 | A1 | 12/2017 |
| WO | 2018149044 | A1 | 8/2018 |
| WO | 2018234969 | A1 | 12/2018 |
| WO | 2019072196 | A1 | 4/2019 |
| WO | 2019073126 | A1 | 4/2019 |
| WO | 2019122087 | A1 | 6/2019 |
| WO | 2019122091 | A1 | 6/2019 |
| WO | 2019122098 | A1 | 6/2019 |
| WO | 2019122176 | A1 | 6/2019 |
| WO | 2019122185 | A1 | 6/2019 |
| WO | 2019122225 | A1 | 6/2019 |
| WO | 2019122321 | A1 | 6/2019 |
| WO | 2019129687 | A1 | 7/2019 |
| WO | 2019141799 | A1 | 7/2019 |
| WO | 2019143276 | A1 | 7/2019 |
| WO | 2019183668 | A1 | 10/2019 |
| WO | 2019203135 | A1 | 10/2019 |
| WO | 2019222119 | A1 | 11/2019 |
| WO | 2020042299 | A1 | 3/2020 |
| WO | 2020042300 | A1 | 3/2020 |
| WO | 2020042301 | A1 | 3/2020 |
| WO | 2020042302 | A1 | 3/2020 |
| WO | 2020056822 | A1 | 3/2020 |
| WO | 2020056823 | A1 | 3/2020 |
| WO | 2020107665 | A1 | 6/2020 |
| WO | 2020113768 | A1 | 6/2020 |
| WO | 2020176033 | A1 | 9/2020 |

* cited by examiner
† cited by third party

WATERCRAFT DEVICE WITH HYDROFOIL AND ELECTRIC PROPELLER SYSTEM

CROSS-REFERENCE TO RELATED APPLICATION

This application is a continuation application, pursuant to the provisions of 35 U.S.C. § 120, of prior U.S. patent application Ser. No. 15/700,658 titled "WATERCRAFT DEVICE WITH HYDROFOIL AND ELECTRIC PROPELLER SYSTEM" by Montague et al., filed on 11 Sep. 2017, the entirety of which is incorporated herein by reference for all purposes.

U.S. patent application Ser. No. 15/700,658 claims benefit under 35 USC 119(e) of U.S. Provisional Patent Application No. 62/393,580, filed on Sep. 12, 2016, entitled "JET-FOILER," which is incorporated herein by referenced in its entirety.

FIELD OF THE INVENTION

This application relates to watercraft devices that include hydrofoils and that are powered using electric propeller systems.

BACKGROUND

There are boards with hydrofoils (or foils) for use with kites, paddles, and windsurf rigs. There are electric and gas-powered boards without foils. U.S. Pat. No. 7,047,901 discloses a motorized hydrofoil device. U.S. Pat. No. 9,278,729 discloses a weight-shift controlled personal hydrofoil watercraft. The disclosures of the above identified patent documents are hereby incorporated herein by reference.

SUMMARY

Disclosed herein are aspects, features, elements, implementations, and implementations for providing watercraft devices that include hydrofoils and that are powered using electric propeller systems.

In an implementation, a watercraft device is disclosed. The watercraft device comprises a board, a throttle coupled to a top surface of the board, a hydrofoil coupled to a bottom surface of the board, and an electric propeller system coupled to the hydrofoil, wherein the electric propeller system powers the watercraft device using information generated from the throttle, further wherein a center of buoyancy in a non-foiling mode and a center of lift in a foiling mode are aligned.

One aspect disclosed herein is directed to a modular, weight-shift controlled watercraft device, comprising: a modular board removably attachable to a power system; the power system including a modular power supply system, and a modular propulsion system; the power supply system including a housing, the housing including a first battery; the propulsion system including a modular strut, a modular propulsion pod, and a modular hydrofoil; wherein the propulsion pod is removably attachable to the strut; wherein the hydrofoil is removably attachable to the strut; and wherein the power supply system is removably and mechanically attachable directly to the propulsion system.

Another aspect disclosed herein is directed to a modular, weight-shift controlled watercraft device, comprising: a modular board removably attachable to a power system; the power system including a modular power supply system, and a modular propulsion system; the power supply system including a housing, the housing including a first battery; the propulsion system including a modular strut, a modular propulsion pod, and a modular hydrofoil; wherein the propulsion pod is removably attachable to the strut; wherein the strut includes a first end portion, a second end portion, and a strut body disposed between the first end portion and second end portion; wherein the board is removably attachable to the first end portion of the strut; wherein the hydrofoil is attachable to the strut at a first location; and wherein the propulsion pod is attachable to the strut at a second location interposed between the first end portion and the first location.

In at least one embodiment, the power supply system is removably attachable directly to the strut of the propulsion system. In at least one embodiment, the power supply system is removably attachable directly to the strut of the propulsion system independent of any coupling to the board.

In at least one embodiment, the housing and the first battery are coupled to each other to form an integral modular unit; and the integral modular unit is removably attachable directly to the strut of the propulsion system.

In at least one embodiment, the propulsion pod is removably attachable directly to the strut; and the hydrofoil is removably attachable directly to the strut.

In at least one embodiment, the power supply system is removably housed within a well of the board; and the power supply system includes a top surface forming an upper surface portion of the board.

In at least one embodiment, the strut includes a first end portion, a second end portion, and a strut body disposed between the first end portion and second end portion; the board is attachable to the first end portion of the strut; the hydrofoil is attachable to the strut at a first location; and the propulsion pod is attachable to the strut at a second location interposed between the first end portion and the first location.

In at least one embodiment, the watercraft device is configured or designed to provide a weigh-shift controlled steering mechanism which enables an operator of the watercraft device to steer the watercraft device solely via weight-shift of the operator.

In at least one embodiment, watercraft device further comprises: a wireless throttle controller, the throttle controller including a first input interface configured to receive input from an operator of the watercraft device, the throttle controller being configured to provide a first wireless control signal in response to first input received via the first input interface; a drive system that includes an electric motor, a motor controller, a propeller, and a second input interface configured to receive at least one wireless control signal generated by the throttle controller; and the drive system is configured to dynamically alter an output of the electric motor in response receiving at least one control signal generated by the throttle controller.

In at least one embodiment, the board is removably attachable to the propulsion system. In at least one embodiment, the board is removably attachable to the strut. In at least one embodiment, the board is removably attachable to the power supply system.

In at least one embodiment, the hydrofoil includes a fuselage and at least one wing attachable to the fuselage, and the fuselage is removably attachable to the strut.

In at least one embodiment, watercraft device further comprises: a wireless throttle controller, the throttle controller including a first input interface configured to receive input from an operator of the watercraft device, the throttle controller being configured to provide a first wireless control signal in response to first input received via the first input interface; a drive system that includes an electric motor, a motor controller, a foldable propeller, and a second input interface configured to receive at least one wireless control signal generated by the throttle controller; and wherein the foldable propeller is responsive to a second wireless control signal generated by the wireless throttle controller for causing the foldable propeller to be in an unfolded position, and wherein the foldable propeller is further responsive to a third wireless control signal generated by the wireless throttle controller for causing the foldable propeller to be in a folded position.

In at least one embodiment, watercraft device further comprises: a ride height sensor system including a ride height sensor attachable to the propulsion system; and the ride height sensor system being configured to determine a distance between a bottom surface of the board and a top surface of water in which the watercraft device is deployed.

In at least one embodiment, at least one electrical conduit electrically coupled to the first battery and the propulsion pod, wherein the first battery is electrically coupled to the propulsion pod via the at least one electrical conduit; wherein the board includes a board body having an exterior surface defining a board body interior; and wherein an entirety of the board body interior is devoid of the at least one electrical conduit.

In at least one embodiment, the first battery is electrically coupled to the propulsion pod via at least one electrical conduit; the propulsion pod includes an electric motor and a propeller physically attachable to the electric motor; the power supply system includes a motor controller, the motor controller being electrically coupled to the electric motor via the at least one electrical conduit; the power supply system is removably housed within a well of the board; and the power supply system includes a top surface forming an upper surface portion of the board.

In at least one embodiment, the first battery is electrically coupled to the propulsion pod via at least one electrical conduit; and the propulsion pod includes an electric motor, a motor controller electrically coupled to the electric motor, and a propeller physically attachable to the electric motor.

These and other aspects of the present disclosure are disclosed in the following detailed description of the embodiments, the appended claims and the accompanying figures.

BRIEF DESCRIPTION OF THE DRAWINGS

The disclosed technology is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

The following description and drawings are illustrative and are not to be construed as limiting. Numerous specific details are described to provide a thorough understanding. However, in certain instances, well known or conventional details are not described in order to avoid obscuring the description. References to one or an embodiment in the present disclosure are not necessarily references to the same embodiment; and, such references mean at least one.

A foilboard (also referred to as a foiling device or a hydrofoil board/device) is a watercraft device that includes a surfboard (also referred to as a board) and a hydrofoil that is coupled to the board and that extends below the board into the water during operation. The hydrofoil generates lift, which causes the board to rise above a surface of a body of water at higher speeds. The present disclosure provides jetfoilers which represent a watercraft device that includes a hydrofoil board (i.e., a board with a hydrofoil coupled beneath the board's surface) and an electric propeller system (i.e., a propeller system powered using an electric motor) that powers the watercraft device. The jetfoilers can also be referred to as electric hydrofoil devices. The jetfoilers introduce hydrofoil sports to a wide audience by providing a quiet alternative to gas-powered personal watercraft, a more efficient no-wake alternative to non-foiling craft, and/or a no-wind or low-wind option for individuals to use hydrofoil devices for recreation. Accordingly, a method and system in accordance with the present disclosure provides a jetfoiler that comprises a board, a hydrofoil coupled to the board, and an electric propeller system coupled to the hydrofoil for powering the jetfoiler. The hydrofoil may be detached from the board using a quick release when not in use to allow the operator to store or move the jetfoiler more easily. An operator of the jetfoiler can use weight-shifting or another mechanism using a controller to control both a speed and a direction of the jetfoiler. Thus, the jetfoiler is an electric powered personal surfboard watercraft that utilizes hydrofoils and is safe, easy to ride, and easy to transport.

Figure 1:
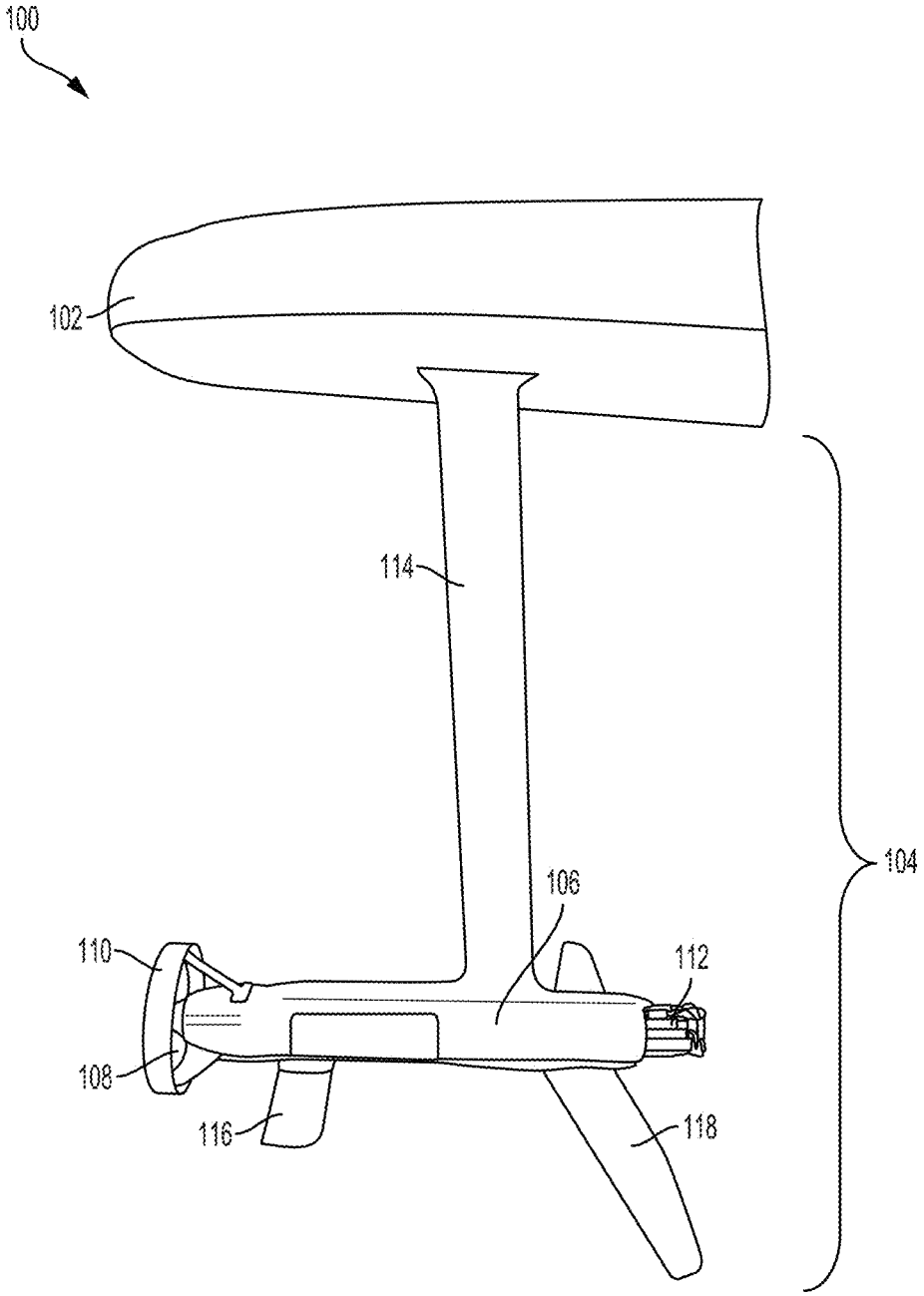
FIG. 1 illustrates an example of a portion of a jetfoiler in accordance with implementations of the present disclosure.

FIG. 1 illustrates an example of a portion of a jetfoiler 100 in accordance with implementations of the present disclosure. The jetfoiler 100 includes a board 102, a hydrofoil 104 coupled to the board 102, a propulsion pod 106 coupled to the hydrofoil 104, a propeller 108 coupled to the propulsion pod 106, and a propeller guard 110 surrounding the propeller 108. In some implementations, the jetfoiler 100 includes the propeller 108 without the propeller guard 110. When the board 102 floats on a surface of a body of water (e.g., a lake or ocean), the hydrofoil 104 is submerged under the surface of the water body (i.e., the hydrofoil 104 is within the body of water). When the jetfoiler 100 reaches a sufficient or predetermined speed, lift generated by the hydrofoil 104 lifts the board 102 over the surface of the body of water. Therefore, the hydrofoil 104 provides lift for the jetfoiler 100. The jetfoiler 100 may include a variety of hydrofoil combinations including but not limited to only the hydrofoil 104, more than one hydrofoil, and a hydrofoil coupled with a canard. The board 102 can have quick connectors to facilitate the removal/detachment of the hydrofoil 104 from the board 102.

An operator (also referred to as a rider or user) of the jetfoiler 100 can stand on a top surface of the board 102 in a standing position and can use a controller (not shown) coupled to the board 102 to control the jetfoiler 100. The controller can also be referred to as a throttle controller. The board 102 can serve as a flotation device and includes a forward section, a middle section, and a rear section. The longitudinal and directional control of the jetfoiler 100 can be controlled by the operator using any of weight-shifting, engaging with the controller (e.g., the operator moving a joystick or knob to the right thereby turning the jetfoiler 100 in the right direction), and using predetermined routes (e.g., the operator inputting a route prior to operating the jetfoiler 100 and the jetfoiler 100 automatically following that pathway using GPS coordinates). In addition, stability of the jetfoiler 100 can be controlled by the operator using any of weight-shifting, engaging with the controller (e.g., the operator clicking a button to rebalance and stabilize the jetfoiler 100 around a sharp turn), and using another device built-into the jetfoiler 100 (e.g., a MEMS device including but not limited to a gyroscope).

The operator can also be disposed on the top surface of the board 102 in a prone or kneeling position (in addition to the standing position). The jetfoiler 100 can also be operated while the operator is sitting on the board 102 or while the operator is seated in a chair positioned on or coupled to the top surface of the board 102. The propulsion pod 106 can include or house a power system 112 that can receive instructions from the controller (i.e., based on the operator's usage of the controller) to power the propeller 108 (e.g., using a motor of the power system 112) thereby serving as a propulsion system to operate the jetfoiler 100. The power system 112 can include but is not limited to any of a motor, a motor controller (e.g., an electronic speed control (ESC)), a battery system, and a cooling system. The power system 112 can be fully housed within the propulsion pod 106 and is revealed in FIG. 1 for illustration purposes. The power system 112 can power the propeller 108 via a shaft using electric power from a motor (e.g., an electric motor) to generate thrust, causing the jetfoiler 100 to gain speed on the surface of the body of water. The controller can comprise a throttle that controls the speed of the jetfoiler 100 via the power system 112 by adjusting the thrust generated by the propeller 108.

The hydrofoil 104 can comprise a plurality of components including but not limited to a strut 114, an aft wing 116, and a forward wing 118. In some implementations, only one wing (the aft wing 116 or the forward wing 118 or another wing) is coupled to the hydrofoil 104. In other implementations, more than two wings are coupled to the hydrofoil 104. In some implementations, the propulsion pod 106, the power system 112, the propeller 108, and the propeller guard 110 are also referred to as components of the hydrofoil 104. The position of any of the plurality of components of the hydrofoil 104 can be adjustable so that the hydrofoil 104 and the board 102 are coupled using adjustable distances. The strut 114 has an upper end and a lower end with the upper end being coupled to a bottom surface of the board 102. The upper end of the strut 114 can be coupled to the bottom surface of the board 102 in a variety of locations including but not limited to between the middle and rear sections and near the middle section. The coupling between the strut 114 and the board 102 can be a fixed interconnection (e.g., using bolts) or a detachable connection (e.g., using a waterproof electrical socket with a clipping mechanism). The coupling between the strut 114 and the board 102 can also be referred to as a strut attachment mechanism.

In some embodiments, the strut attachment mechanism is a clipping mechanism that includes two mating plastic parts to form a socket connection, wherein one of the two mating plastic parts fits into the strut 114, and the other of the two mating plastic parts fits into the board 102. The one of the plastic parts (e.g. the board side part) can be fitted with O-rings, so that when the two mating plastic parts mate together to form an attachment, the attachment prevents water intrusion. Sealed spring-loaded electrical connectors (e.g., three bullet connectors) can fit into dedicated compartments in the two mating plastic parts. One half of each connector can fit into the board-side plastic part and the corresponding one half can fit into the strut-side plastic part. The sealed spring-loaded electrical connectors can attach to wires in the board 102 and the strut 114, respectively. When attached, the sealed spring-loaded electrical connectors can form a continuous wire run from the board 102 to the propulsion pod 106.

The strut attachment mechanism can also be designed with a hinge mechanism, where the user would snap one edge of the top of the strut 114 into the hinge mechanism on the bottom of the board 102. This allows the user to rotate the strut 114 upright where it could snap into place using a locking mechanism (e.g., a pawl latch). To enable a hinge mechanism to serve as the strut attachment mechanism, the electrical connectors are shaped differently from a bullet shape so that they can fit into sockets (e.g., spade lug sockets).

The strut 114 can connect the board 102 to the propulsion pod 106 and both the aft wing 116 and the forward wing 118 can be coupled to the propulsion pod 106. The aft wing 116 and the forward wing 118 can be collectively referred to as hydrofoil wings 116-118. The propulsion pod 106 may be positioned forward of the strut 114, aft of the strut 114, or centered around the strut 114. The positioning of the propulsion pod 106 vis-à-vis the strut 114 will affect the positioning of the propeller 108 vis-à-vis the strut 114, and may affect the positioning of the hydrofoil wings 116-118 if they are coupled to the propulsion pod 106. The aft and the forward wings 116-118 can also be coupled to a horizontal fuselage that is coupled the strut 114 (e.g., either above the propulsion pod 106 or near a lower end of the strut 114 that is below the propulsion pod 106) as opposed to indirectly via the propulsion pod 106. The aft and the forward wings 116-118 can be coupled to any of a bottom surface, a top surface, and a middle section (between the bottom and top surface) of the propulsion pod 106. In some implementations, the aft and the forward wings 116-118 are coupled to the bottom surface of the propulsion pod 106; therefore, the hydrofoil 104 includes a structure that does not integrate the aft and the forward wings 116-118 with the propulsion pod 106. The strut 114 can be connected to the board 102 via a strut slot that provides an opening on both a bottom surface and a top surface of the board 102 at a similar location. The strut slot can vary in shape and size and can comprise a thin rectangular line opening. The strut 114 can be a vertical strut with similar dimensions (e.g., rectangular shape) or varying dimensions (e.g., tapered shape) between the upper end and the lower.

The aft and forward wings 116-118 can be horizontal wings that extend from both sides of the propulsion pod 106. The aft and forward wings 116-118 (and any other wings coupled to the propulsion pod 106) can include a variety of sizes and designs (e.g., different curved flaps, winglets coming off the edges, etc.) to enable customization of the jetfoiler 100 according to experience levels and desires of the operator. The aft and forward wings 116-118 can be fixed components of the hydrofoil 104 or the aft and forward wings 116-118 can be or can contain movable structures that are controlled by an operator of the jetfoiler 100 (e.g., controlled using the controller). In addition, other components of the hydrofoil 104 can be movable or repositionable using the controller. For example, the strut 114 or the propulsion pod 106 can be moved to different positions with varying angles. The operator can move various components of the hydrofoil 104 including the aft and the forward wings 116-118 based on varying conditions including but not limited to experience level and performance requirements.

The propulsion pod 106 is an underwater housing used to integrate a propulsion system (i.e., a system comprising at least the propeller 108 and part of the power system 112) into the strut 114 to provide a combined component. The propulsion system can also be referred to as a propeller system. The combined component can be manufactured to have a continuous shell of carbon fiber, aluminum, or another similar material. The combined component can provide both the housing of the propulsion pod 106 and the strut 114 thereby reducing parts, assembling effort, and manufacturing costs while increasing structural integrity. The propulsion pod 106 may also be detachable from the strut 114 to enable the two parts (i.e., the propulsion pod 106 and the strut 114) to be manufactured more easily (e.g., in separate factories and quickly assembled or disassembled for repair). The aft and forward wings 116-118 can be secured to the propulsion pod 106 via a plurality of mechanisms including but not limited to removable bolts. The propulsion pod 106 can house a motor and other components (e.g., motor controller, battery, etc.) of the power system 112 and can also act as a spacer between the aft and forward wings 116-118.

In some implementations, the propulsion pod 106 can be integrated into the strut 114 above a horizontal part (e.g., a fuselage) of the hydrofoil 104; therefore, the motor and other components of the power system 112 are housed elsewhere from the propulsion pod 106 (i.e., the power system 112 is not housed within the propulsion pod 106). In another implementation, parts of the power system 112, including a motor and a gearbox (if a gearbox is used) and optionally a motor controller (e.g., an ESC) are housed in the propulsion pod 106, while the battery system or batteries are housed elsewhere (e.g., in the board 102). In other implementations, the propulsion pod 106 is a separate component that can be attached to and detached from the strut 114 (i.e., the propulsion pod 106 and the strut 114 are not one continuous combined component) to allow the propulsion pod 106 to be carried to a charging location/station to change or charge a battery of the power system 112 stored within the propulsion pod 106 without having to also carry the strut 114 and/or the entire jetfoiler 100 to the charging location/station.

The board 102 can be a lightweight, low-drag platform that is longer than it is wide (i.e., a length of the board 102 is greater than a width of the board 102). The board 102 can be made of a buoyant material (e.g., polyurethane or polystyrene foam or a similar type of foam covered with layers of fiberglass cloth or carbon cloth or a similar type of cloth and a polyester resin or epoxy resin or a similar type of resin) that is designed to provide the operator with a place to stand when the jetfoiler 100 is in use. In some implementations, the board 102 includes a design shape that works with both the hydrofoil 104 and the operator's unique characteristics (e.g., expertise level, height, weight, etc.). For example, the board 102 can include a beginner shape that is large, more buoyant, and does not include a planing mode or the board 102 can include an advanced shape that is small, not buoyant enough for the operator to stand on the board 102 while it is stationary, and does include a planing mode.

In some implementations, the board 102 includes a design shape (or is shaped) so that drag versus velocity curves of the board 102 in displacement (or non-foiling) mode, foiling mode, and where applicable, planing mode, are complimentary thereby achieving a smooth transition between modes, both during takeoff (i.e., when the operator is starting operation of the jetfoiler 100) and during landing (i.e., when the operator is ending operation of the jetfoiler 100) of the jetfoiler 100. The board 102 can include a mechanism that enables the board 102 to be aware of (or can determine) which mode (e.g., non-foiling mode, foiling mode, planing mode, etc.) the board 102 is currently within or will pass through to provide smooth transition between the various modes. The jetfoiler 100 is a foiling device and so the operator may transition between modes accidentally when speed is changed thereby causing operators with a beginner level of experience to spend a lot of time between modes. Therefore, a smooth transition makes it easier to operate the jetfoiler 100 and allows the operator to slow down or speed up without falling as the jetfoiler 100 transitions between the various modes.

When the board 102 is in contact with the surface of the body of water to obtain buoyancy (e.g., when the operator is about to takeoff), the jetfoiler 100 is in a non-foiling (or displacement) mode. When the board 102 is above the surface of the body of water and obtains no buoyancy from the water (e.g., when the operator is operating the jetfoiler 100), the jetfoiler 100 is in a foiling mode. When the jetfoiler 100 is partially supported by the lift generated by the board 102 gliding at a certain speed on the surface of the body of water and before reaching another speed that puts the jetfoiler 100 in the foiling mode, the jetfoiler 100 is in a planing mode. Watercrafts (e.g., boats) that are designed to plane at low speeds include a design with planing hulls that enable the watercrafts to rise up partially out of the water when enough power is supplied. The board 102 can be similarly shaped/designed to have a design shape with a planning hull for the planing mode. In some implementations, the board 102 may provide enough buoyancy to support the full weight of the operator during the non-foiling mode.

The design shape of the board 102 and wing placement of the jetfoiler 100 can be configured in such a way that a center of buoyancy of the jetfoiler 100 in the non-foiling mode and a center of lift from the hydrofoil wings 116-118 in the foiling mode are aligned or substantially aligned. In other words, an upward force generated by a buoyancy of the board 102 when the board 102 is touching a body of water (e.g., the board 102 is in displacement or non-foiling mode) centered in approximately a same position and in a same direction (e.g., in the forward/aft direction) as an upward force from a lift generated by the hydrofoil wings 116-118 when the board 102 is foiling (e.g., the board 102 is in foiling mode). Therefore, the shape and composition of the board 102 is correlated to the position of the hydrofoil wings 116-118 to provide an alignment that matches the center of buoyancy to the center of lift.

The alignment between the center of buoyancy and the center of lift means that minimal repositioning is required for the operator to maintain stability during transitioning of modes (i.e., the operator of the jetfoiler 100 does not have to change foot positioning or substantially redistribute his or her weight as s/he transitions from non-foiling mode to foiling mode or from foiling mode to non-foiling mode, etc.), making the jetfoiler 100 easier to ride. In addition, the operator does not need to sit or lie on the board 102 to transition from the non-foiling mode to the foiling mode. Positioning of the hydrofoil wings 116-118 will determine the positioning of the center of lift when the jetfoiler 100 is in foiling mode and will determine optimal body positioning for the operator when the board 102 is in foiling mode.

The jetfoiler 100 can include a variety of features to provide increased safety during operation including but not limited to safety shut-offs, speed limitations, and sensor data collection and analysis. For example, the jetfoiler 100 can include an ankle-tethered magnetic kill switch to provide an additional level of safety (beyond a level of safety garnered from the operator being able to release or let go of the throttle) if the operator falls into the body of water during operation (i.e., the jetfoiler 100 can shut off when the operator falls into the water with the kill switch that has released from the jetfoiler 100). The jetfoiler 100 can also be configured to provide motor braking when a kill switch tether (e.g., the ankle-tethered magnetic kill switch attached to the operator) is detected by the jetfoiler 100 to be detached even if the operator hasn't fallen off the jetfoiler 100.

In addition, during normal operation, the jetfoiler 100 can be configured to transition from the non-foiling mode to the foiling mode between a predetermined speed (e.g., 8-10 knots). The throttle of the jetfoiler 100 can be limited to reach a predetermined maximum or peak speed limit (e.g., 15 knots peak speed) to further enhance safety. Smart throttle limiting options can also be implemented to make it easier to change the peak speed limit. For example, the operator can set an experience level to beginner which would automatically lower the peak speed limit in comparison to the higher peak speed limit set for an operation with an advanced experience level. The jetfoiler 100 can also use a folding propeller (i.e., a propeller system with propeller blades that can fold to various positions including a collapsed position that reduces potential harm from coming into contact with the propeller blades) that increases operator safety by collapsing from one position to another position when not deliberately in use. The jetfoiler 100 can have device-specific battery packs (e.g., LiFePO4 or Lilon batteries) that further increase the safety of the device. The jetfoiler 100 can include a variety of sensors to detect data associated with leaks, fallen operators, damaged propellers and/or wings (or other components of the jetfoiler 100) and can transmit the detected data to the operator or third-parties (e.g., rental shop) to improve the safety and operation of the jetfoiler 100.

The jetfoiler 100 can include a variety of features to provide easy portability and transportation. For example, the board 102 can be made of a carbon fiber material that keeps the jetfoiler 100 lightweight. The jetfoiler 100 can include batteries within the power system 112 that are reduced in size and/or weight which also contributes to a lighter weight. A hydrofoil (e.g., the hydrofoil 104) of the jetfoiler 100 can comprise a single hydrofoil having one vertical strut (e.g., the strut 114) and two horizontal wings (the aft and forward wings 116-118) to provide lift using a simplified structure that makes the jetfoiler 100 easy for one or two persons to carry and to launch into the water for takeoff. Alternatively, the hydrofoil of the jetfoiler 100 can include a structure that is more complex than the hydrofoil 104 and that comprises a plurality of struts and a plurality of wings in addition to an aft wing and a forward wing that are coupled together in a variety of positions and shapes.

In addition, the jetfoiler 100 can also use a detachable wing design that allows the jetfoiler 100 to be made smaller so that it can be packed into a carrying device for transportation. The board 102 of the jetfoiler 100 can also be made of an inflatable material to make it easy to transport when the board 102 is reduced in size by being in its deflated state. The board 102 can include one or more retractable or detachable wheels that allow a single person to roll the jetfoiler 100 across a ground surface (e.g., a dock, a boat deck, a beach, etc.). The board 102 can have quick connectors for on-board electronics that enable detachment of the hydrofoil 104 from the board 102 (e.g., as aforementioned with regards to the various strut attachment mechanisms). The on-board electronics can comprise electronics for controlling operation/speed of the jetfoiler 100 that are stored within wells that are built-into the top surface of the board 102.

Figure 2:
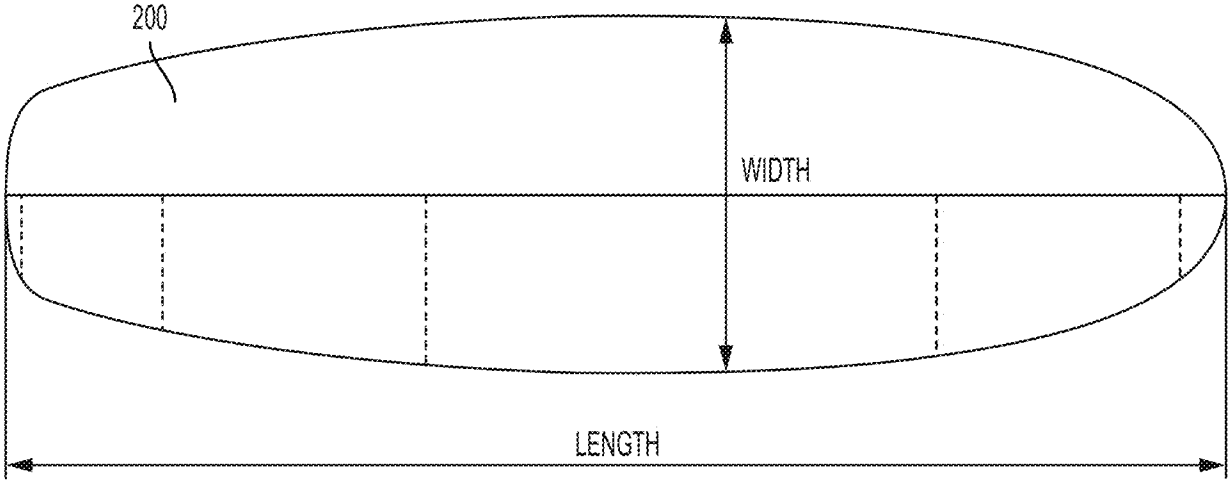
FIG. 2 illustrates a top view of an example of a board of a jetfoiler in accordance with implementations of the present disclosure.

FIG. 2 illustrates a top view of an example of a board 200 of a jetfoiler in accordance with implementations of the present disclosure. The board 200 is a component of the jetfoiler (e.g., the jetfoiler 100 of FIG. 1) that is coupled to a hydrofoil of the jetfoiler. The board 200 has dimensions that can include a length that is greater than a width. For example, the length of the board 200 can be approximately 2365 millimeters (mm) and the width of the board 200 can be approximately 698 mm. The board 200 can have symmetrical dimensions so that opposite sides of the board 200 are identical or can have asymmetrical dimensions. The board can come in a variety of different shapes and sizes. For example, a jetfoiler can include a board that is smaller and shaped for higher-performance in comparison to the board 200. The smaller board could be one in which an operator (i.e., user/rider) could not stand until the board were in motion. Such boards can be configured with handles to help the operator shift from a prone or lying down position to a standing position.

The board 200 can include a variety of different length and width measurements based on varying considerations including but not limited to the experience level of an operator of the jetfoiler (e.g., larger dimensions for beginner operators and smaller dimensions for advanced operators). In one example, for beginner operators, the board 200 can be larger in size (i.e., the board 200 includes a longer length and a longer width) so that it is easier to stand on when not foiling. In another example, the board 200 can be smaller in size (i.e., the board 200 includes a shorter length and a shorter width in comparison to the larger size used for beginner operators) thereby improving performance (e.g., reduced drag on the board 200, reduced time period to transition from non-foiling mode to foiling mode, enhanced power efficiency, etc.) for more advanced operators. The board 200 also includes a thickness that can vary for similar performance requirements (e.g., thicker dimensions for beginner operators and thinner dimensions for advanced operators). If the board 200 is smaller and/or narrower, the board 200 may include handles to make it easier for the operator to transition from non-foiling to foiling mode while lying down and to stand up once he/she has put the board 200 in foiling mode.

A jetfoiler (e.g., the jetfoiler 100 of FIG. 1) can be operated by the operator using a controller and can be steered by the operator using weight shifting and feet positioning in relation to a board of the jetfoiler. In addition, the jetfoiler can include an optional rudder-type device coupled to the board to steer the jetfoiler using a movable steering system. The operator can steer or control the jetfoiler using the rudder-type device by engaging with the controller (e.g., moving a knob of the controller to the right to steer the jetfoiler to the right) or the rudder-type device can automatically steer the jetfoiler using machine learning mechanisms and sensors that detect various conditions and adjust the jetfoiler accordingly (e.g., sensors of the jetfoiler recognize that the jetfoiler is leaning too far to the right and so automatically adjust the rudder-type device to balance the jetfoiler by steering the jetfoiler to the left).

Every jetfoiler in operation can record a stream of data (e.g., a high fidelity stream of data) indicating how the rider is operating the jetfoiler and how the jetfoiler is responding (e.g., data recordings associated with speed, elevation, attitude, stability, power and temperatures, etc.). The jetfoiler can optionally upload this data to a central server when connected to the Internet. Machine learning techniques can be employed to alter the responsiveness of each jetfoiler, based on what is learned from the aggregate data from all jetfoilers, to make the board of the jetfoiler easier to ride and less likely to defoil or overheat. The jetfoiler can include additional components including but not limited to adjustable flaps (also referred to as moveable control surfaces) on the aft and forward wings 116-118 (i.e., the hydrofoil wings 116-118), that can be automatically controlled to stabilize the jetfoiler. If the jetfoiler doesn't include the rudder-type device, the jetfoiler can allow the operator to steer the board by positioning his/her feet in foot straps (e.g., pulling back against the foot straps) and by shifting his/her weight. Steering using weight shifting and feet positioning is similar to windsurfing and can simplify the steering process of the jetfoiler for the operator.

Figure 3:
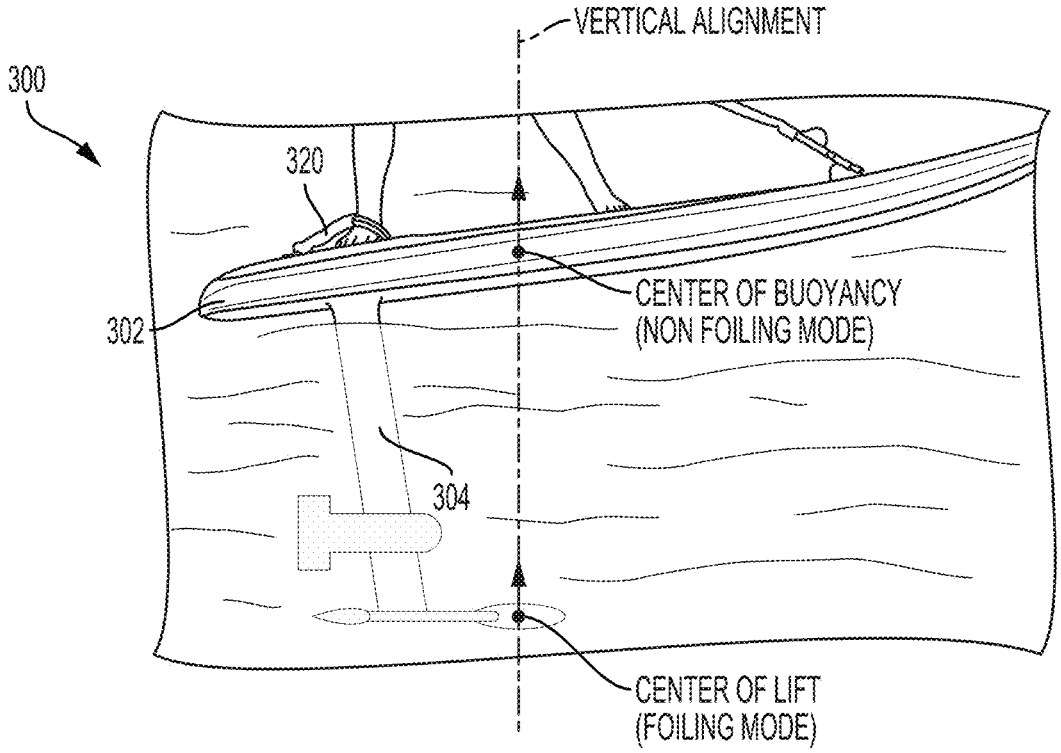
FIG. 3 illustrates a side view of an example of a jetfoiler in accordance with implementations of the present disclosure.

FIG. 3 illustrates a side view of an example of a jetfoiler 300 in accordance with implementations of the present disclosure. The jetfoiler 300 can be similar to the jetfoiler 100 of FIG. 1. The jetfoiler 300 includes a board 302 coupled to a strut component of a hydrofoil 304. Additional components of the hydrofoil 304 (e.g., a propulsion pod, wings, etc.) are not shown as they are submerged below a surface of a body of water. On a top surface of the board 302, the jetfoiler 300 includes at least one footstrap 320 that is used by an operator to operate and to steer the jetfoiler 300. The operator can steer the jetfoiler 300 using the at least one footstrap 320 in a variety of ways including but not limited to adjusting the positioning of his/her feet in related to the at least one footstrap 320, shifting his/her weight across the board 302, pulling back against the at least one footstrap 320, and loosening contact with the at least one footstrap 320.

Figure 4:
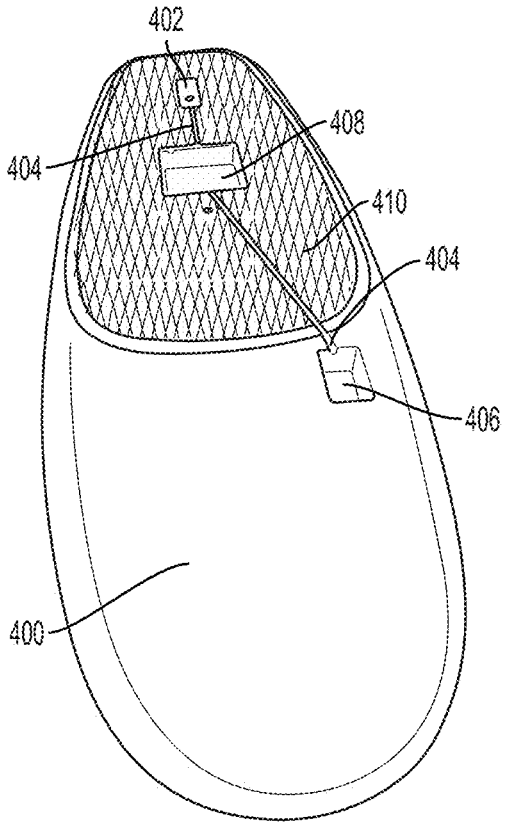
FIG. 4 illustrates a top view of an example of a board of a jetfoiler in accordance with implementations of the present disclosure.

FIG. 4 illustrates a top view of an example of a board 400 of a jetfoiler in accordance with implementations of the present disclosure. The board 400 is a component of the jetfoiler (e.g., the jetfoiler 100 of FIG. 1) that is coupled to a hydrofoil (e.g., the hydrofoil 104 of FIG. 1). The board 400 includes a strut slot 402, a trough 404 running from a first well (also referred to as smaller well) 406 to a second well (also referred to as larger well) 408 and then running from the larger well 408 to the strut slot 402. The strut slot 402 may be positioned inside/underneath the larger well 408. The larger well 408 has a waterproof lid/seal (not shown). Lids can be attached in a variety of ways, for example, with a series of bolts tightened to seal a gasket, or, alternatively, with a bulb seal locked down using a hinge mechanism and latch. When using a hinge mechanism, the board 400 may use a bulb seal made of a variety of materials (e.g., rubber and positioned next to a lip built into the board 400, out of carbon fiber and positioned around an aft well such as the larger well 408). The lip can block residual water from coming into the aft well and also helps push against the bulb seal to ensure that the lid and the board 400 form a watertight fit. The lid can be built out of carbon fiber to mate precisely with the board 400. To seal the lid to the board 400, the jetfoiler could use a hinge mechanism (e.g., two hinges on one side of the lid and a mechanical locking system on the other side of the lid to hold it in place under pressure). Accordingly, the lid can form a large part of the surface of the board 400 and can seal watertight (i.e., form a watertight seal) against the board 400 when it is locked down.

The second well 408 (i.e., an aft well) may be divided into two (or more) compartments to separate the contents of the second well 408 (e.g., a forward compartment for batteries and an aft compartment for other electronics). A tunnel may run through the board material between the two compartments to allow wires to connect the electronics in the two compartments under the seal of a lid of the second well 408. The trough 404 between the second well 408 and the first well 406 may also be covered or sealed and may be constructed to include a tunnel between the two wells 406-408 to allow communication links (e.g., wires) to run between the two wells 406-408 without any water contact.

The first well 406 (i.e., a forward well) may include a variety of electronics including but not limited to microcontrollers, an antenna to receive wireless communications from a throttle, a display (e.g., an LCD display), and a safety kill switch attachment point (e.g., a magnetic attachment point). In versions of the jetfoiler that use a wireless throttle, there is no junction box necessary to connect a throttle cable to the board electronics. The first well 406 may have a lid as well as the second well 408. The lid of the first well 406 may be similar in construction to the lid of the second well 408, or it may be made from a clear material, like plexiglass or glass, when it would be valuable for the operator to see components inside the well (e.g., a display).

A deckpad 410 surrounds at least the strut slot 402, a portion of the trough 404, and the second well 408. The deckpad 410 can cover other areas of the board 400, including covering lids on the second well 408 and the strut slot 402, when the second well 408 and the strut slot 402 are enclosed. The board 400 can made of a variety of materials including but not limited to a carbon fiber external material with a foam core internal material. The board 400 can have a variety of dimensions including but not limited to approximately 7.75 feet×2.25 feet×0.4 feet. A higher-performance board might have dimensions including but not limited to 5 feet×2 feet×0.5 feet.

The board 400 can also include a heat sink (not shown) on a bottom surface of the board 400. The heat sink can be made from a material (e.g., aluminum) that is known to have heat dissipating properties and is in contact with water and/or moving air while the jetfoiler is in operation. The heat sink uses a material known to be a passive heat exchanger to transfer heat generated by the jetfoiler power system into the water or air, in order to absorb excessive or unwanted heat generated during operation of the jetfoiler (e.g., heat generated by electronics or by the power system that can be coupled to the board 400 via the first and the second wells 406-408). For example, when the board 400 houses certain components including but not limited to batteries, motor controllers, and motors within any of the first and the second wells 406-408 instead of housing these components within a power system of a propulsion pod of the hydrofoil (e.g., the power system 112 of the propulsion pod 106 of the hydrofoil 104 of FIG. 1), then the board 400 can include the heat sink to prevent these components from overheating by dissipating heat into the air or water. For example, the heat sink may be made from an aluminum plate built into the bottom surface of the board 400, sometimes coupled to an adjacent aluminum bracket to hold a component (e.g., the motor controller) that is generating unwanted heat. In some implementations, the heat sink of the board 400 is located aft of a strut of the hydrofoil so that water spray generated by the strut passing through the surface of the water (also referred to as strut spray) hits the heat sink thereby providing additional cooling.

The board 400 can include built-in wells (e.g., the first well 406 and the second well 408) to house electronics such as at least one electronics unit. The first and the second wells 406-408 can be sized and spaced in a variety of ways, including divided into smaller compartments, to accommodate particular needs of on-board electronics and an operator of the jetfoiler. The configuration of the first and the second wells 406-408 facilitates removal of electronics (e.g., the at least one electronics unit) to provide streamlined modifications, maintenance, and/or upgrades to be conducted on the jetfoiler and to provide access to a storage unit (e.g., memory card) that stores ride data associated with operation of the jetfoiler (e.g., GPS coordinates, speed, health of components, etc.). In some implementations, a user may access and/or download the ride data wirelessly (i.e., the storage unit can wirelessly communicate the stored ride data), instead of having to remove the storage unit from the electronics unit.

In some implementations, electronics of the board 400 can be secured or embedded within the board 400 instead of being housed within the first and the second wells 406-408 to inhibit removal of the electronics and provide protection (e.g., from water erosion). The second well 408 can be located in an aft one-third (⅓) of the board 400, forward of an aft footstrap (not shown) and centered relative to starboard/port. The trough 404 can be a shallow trough of a predetermined depth to enable a predetermined type of wiring to pass through between the first and the second wells 406-408. The trough 404 may also be fully enclosed, like a tunnel between the two wells for the communication link/wire to pass through. The board 400 can have fewer than two wells or more than two wells in addition to the first and the second wells 406-408. For example, the board 400 can have another well that houses an auxiliary battery for emergency usage. The auxiliary battery can serve as an additional battery relative to the battery housed within a power system of a propulsion pod of the hydrofoil that is coupled to the board 400. As another example, the board 400 can have additional wells for storing personal items (e.g., smartphones) and safety items (e.g., first-aid kit).

The strut slot 402 can be located in the aft one-fourth (¼) of the board 400. The strut of the hydrofoil (not shown) can be bolted to the board 400. The strut can include wires that connect a motor of the jetfoiler (e.g., a motor within the power system) to an electronics unit within the second well 408 that can control the motor. The wires can exit the strut and enter the second well 408 that houses the electronics unit. The strut slot 402 is positioned within the board 400 so that placement of the hydrofoil (and associated wings such as the aft and forward wings 116-118 of FIG. 1) under the board 400 allows alignment of a center of buoyancy in a non-foiling or displacement mode that supports the operator with a center of lift in the foiling mode that supports the operator. The alignment between the center of buoyancy and the center of lift enables the operator to maintain stability during transition/operation between modes without having to shift his/her position substantially.

The trough 404 can not only enable a first wire or cable to run forward from the electronics unit via the second well 408 to the first well 406 but can also enable a second wire or cable to run aft from the electronics unit via the second well 408 to the strut slot 402. The first and second wires can be a variety of wire types including but not limited to straight or coiled wires. A junction box may be used to facilitate transitions between electrical wires, including joining straight and coiled wires. The first wire can enable the throttle to communicate with an electronics unit (e.g., an electronics unit housed within the second well 408) via a junction box (e.g., a junction box located within the first well 406) or directly and without a junction box to adjust speed of the jetfoiler. The second wire can enable the electronics unit to communicate with the power system (and associated motor) housed within the propulsion pod of the hydrofoil that is connected via the strut slot 402 to a surface beneath the board 400.

Therefore, when the throttle is adjusted (i.e., the throttle is pressed/released to increase/decrease speed) by the operator, the electronics unit (e.g., a microcontroller of the electronics unit or a microcontroller that serves as the electronics unit), receives information associated with the adjustment. The information can also first be transmitted to the optional junction box prior to being transmitted to the electronics unit. This information may be relayed wirelessly or via a wired connection (e.g., a coiled throttle wire connecting the throttle to either the junction box or to the electronics unit directly). The electronics unit then processes the information to generate commands that are transmitted to a motor controller coupled to the motor thereby adjusting the motor accordingly via the second wire.

The first well 406 can be located forward of the deckpad 410 to enable a straight wire (e.g., the first wire) instead of the coiled throttle wire to run along the trough 404 and to the second well 408. The first well 406 can be configured to hold or house a junction box which connects a straight wire running from the second well 408 and through the board 400 via the trough 404 to a coiled throttle wire that runs to the throttle (not shown) that is held by the operator to enable operation of the jetfoiler. In some implementations, the board 400 does not include the first well 406 or the junction box housed within; instead, the throttle can be directly coupled to an electronics unit housed within the second well 408, either by a wire or wirelessly, using an antenna. The electronics unit may also be expanded and/or divided, so that some of the electronics are housed in the first well 406 and some of the electronics are housed in the second well 408. The electronics unit can include multiple components including but not limited to microcontrollers, kill switches, displays, junction boxes or similar components, and any other electronic components.

The second well 408 is sized large enough to hold the electronics unit, and can be sized large enough to hold batteries or a battery system. The electronics unit can be divided into two units so that some of the components are housed in the first well 406 and some in the second well 408. The electronics unit can be a variety of types including but not limited to an electronics unit that comprises at least two microcontrollers, a kill switch (e.g., one magnetic safety kill switch), and a display (e.g., one or more LCD or LED displays). A first microcontroller of the electronics unit can be used to safely control a speed of the board 400, by turning the operator's speed input and associated information from a throttle (e.g., a thumb throttle) held by the operator into commands or instructions for a motor controller for a motor of a power system (e.g., the power system 112 of FIG. 1). The operator can adjust the thumb throttle to adjust the speed (e.g., press down on the thumb throttle to increase speed) thereby generating information to adjust the speed of the jetfoiler. The information can be received by the first microcontroller that is in communication with the thumb throttle via a throttle cable (e.g., the coiled throttle wire), or via a wireless link. The information can then be communicated from the first microcontroller to the motor controller via the first wire or cable that runs from the electronics unit of the second well 408 to the first well 406, or via another wire or cable when the microcontroller and motor controller are housed in the same well, or when the motor controller is housed in the propulsion pod. The motor controller can convert the information into commands or instructions that are then communicated by the motor controller to the motor (e.g., electric motor, brushless electric motor, etc.) to adjust the jetfoiler's speed. The first microcontroller can also take input from the kill switch to adjust (i.e., bring to a stop) the jetfoiler's speed.

The second microcontroller of the electronics unit can record data about performance of the jetfoiler (or various components of the jetfoiler including but not limited to the motor). The data can be referred to as ride data and can be stored via a storage device (e.g., SD card) associated with the electronics unit. The electronics unit can include additional microcontrollers for providing additional functionality including but not limited to a microcontroller that functions as a receiver to talk to a microcontroller that functions as a transmitter in a wireless throttle, a microcontroller that records ride data, a microcontroller that monitors the battery, and a microcontroller that can send and receive communications with a third-party device (e.g., wireless communications of the ride data). The first or second or any additional microcontrollers can be configured to have a variety of functions including but not limited to limiting speed, changing display options, controlling throttle curves, etc. The configurations of the additional microcontrollers can be made manually or can be adjusted wirelessly (e.g., based on a user interface provided via an application on a mobile device, a tablet, computer, etc.). Additional microcontrollers may exist in the jetfoiler system outside of the board 400, for example, in the throttle controller, as a wireless transmitter, or in the propulsion pod, as a temperature monitor.

The display of the electronics unit can be a variety of displays including but not limited to an LCD or LED display. The display or a separate display can be located on the throttle, an optional handlebar coupled to both the throttle and the board, in an optional console area or additional well, or elsewhere on the jetfoiler or on a wireless throttle or wearable display held or worn by the operator. There can be more than one display and the display can be configured to show a variety of information including but not limited to battery life status (e.g., time until charge needed), temperature (e.g., of the environment, of the water, of the motor, etc.), battery voltage, current, power, percentage of throttle in use, motor rpm and other information (e.g., health of various components such as the propeller system or motor). For example, the display can provide a low battery alarm, show telemetry, display a message to return back to the start location, encourage the rider to ride more efficiently or safely (e.g., reduce speed), display error codes, and/or indicate whether or not the jetfoiler has activated its emergency stop (letting users know that the jetfoiler is not broken but instead has turned itself off for safety reasons or that the kill switch was accidentally triggered, etc.).

The electronics unit of the second well 408 or any other on-board electronics that are coupled to the board 400 or built into the throttle unit can include a variety of different components. For example, the on-board electronics can include a Global Positioning System (GPS) or similar location tracking mechanism to record jetfoiler position during operation and/or storage. This information can be used to advise the user when to return to a starting position and can be part of the ride data. As another example, the components can include sensors or device electronics that detect leaks, fallen riders, collisions, improper battery hookups, fouled propellers, and/or low power system efficiency. The jetfoiler can be configured to shut down the power system when any of these conditions or any combination thereof are detected by the on-board electronics. The on-board electronics can include additional components that advise the user about the detected conditions via a plurality of alert mechanisms including but not limited to beep codes, alarms, vibrations, lights (e.g., red flashing light), text messages, other communication messages (e.g., email), or any combination thereof. The alert mechanisms can be displayed via the display of the electronics unit, the board 400 itself, the throttle, a wristband worn by the operator, or any other visible area of the jetfoiler.

The deckpad 410 can comprise a rubber padding or similar coating to provide operator stability. For example, the deckpad 410 can be made from Ethylene Vinyl Acetate (EVA) to provide cushion and traction for the operator/rider. The deckpad 410 can cover the strut slot 402 and the trough 404 and may also cover the first and/or the second wells 406-408 when the wells are enclosed (e.g., enclosed using a lid). The deckpad 410 can also be placed within other areas. One or more footstraps (e.g., the at least one footstrap 320 of FIG. 3) are located on the board 400 to provide proper rider weight distribution and rider control. Several holes can be drilled into the board 400 to allow operators to position the one or more footstraps in a way that is appropriate for the operator's age, height, weight, stance, riding style (e.g., regular or goofy), and skill level.

The kill switch housed within the first well 406 or the second well 408 (or another area of the board 400) can operate as a "dead man's switch" which is a physical switch that stops the jetfoiler from running if the operator falls off via separation between the kill switch and a contactor. The operator can attach a tether to his/her ankle so that when he/she falls off the jetfoiler, the tether pulls the kill switch (e.g., pulls a magnetic clip that couples the kill switch to the electronics unit via the contactor) away from the board 400 which activates the kill switch and shuts or slows down the jetfoiler. In some implementations, the kill switch can be activated by a radio link between a pendant and a controller of the electronics unit. When the operator falls off the board 400, the jetfoiler is shut down by killing a logic voltage to the controller instead of by separating the contactor of the physical switch from the board 400. The kill switch can be used to provide a motor braking option. When the kill switch is activated (either via disruption of the physical switch or via the radio link), the motor controller can control the motor to reduce the speed of the jetfoiler and thus stop the jetfoiler for safety.

In addition to the kill switch, various hardware and software fail-safe mechanisms can be added to the jetfoiler. For example, if software processed by the electronics unit detects a device speed above or below a certain threshold that the throttle controls (e.g., the speed detected is above a peak speed limit that the jetfoiler should not be able to go over), the software (e.g., by sending an instruction to the motor via the electronics unit) can shut or slow down the jetfoiler. If the software detects current when the throttle is not engaged, the jetfoiler can be shut down or an error message displayed. In another example, if the jetfoiler accelerates without drawing the right amount of current or accelerates faster than it could with an operator on board, the jetfoiler can also be shut or slowed down.

Figure 5:
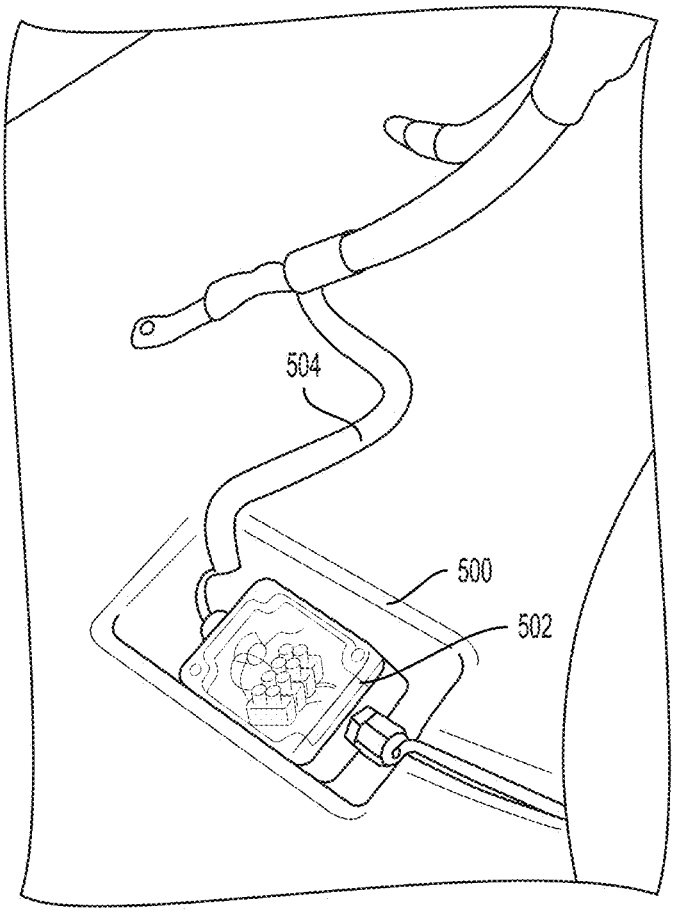
FIG. 5 illustrates an example of a first well within a board of a jetfoiler in accordance with implementations of the present disclosure.

FIG. 5 illustrates an example of a first well 500 within a board of a jetfoiler in accordance with implementations of the present disclosure. The first well 500 can be created or built-in directly into a top surface of the board (e.g., the board 400 of FIG. 4). The first well 500 houses a junction box 502 that is connected to a throttle cable 504 that receives inputs from an operator of the jetfoiler. For example, the operator can engage with (e.g., press, release, move a joystick, etc.) a throttle controller coupled to the throttle cable 504 and the information associated with the engaged action is transmitted to the junction box 502. The first well 500 is a smaller well (e.g., the first/smaller well 406 of FIG. 4) in comparison to a larger well (e.g., the second/larger well 408 of FIG. 4).

The larger well can house an electronics unit that can receive the information from the junction box 502 for processing thereby generating commands or instructions that can then be transmitted to an electric propeller system of the jetfoiler to control operation of the jetfoiler. For example, a motor controller (e.g., an ESC) that controls a motor of the electric propeller system can receive a command from the electronics unit to increase speed of the jetfoiler thereby resulting in the speed of the jetfoiler being increased via the electric propeller system.

Figure 6:
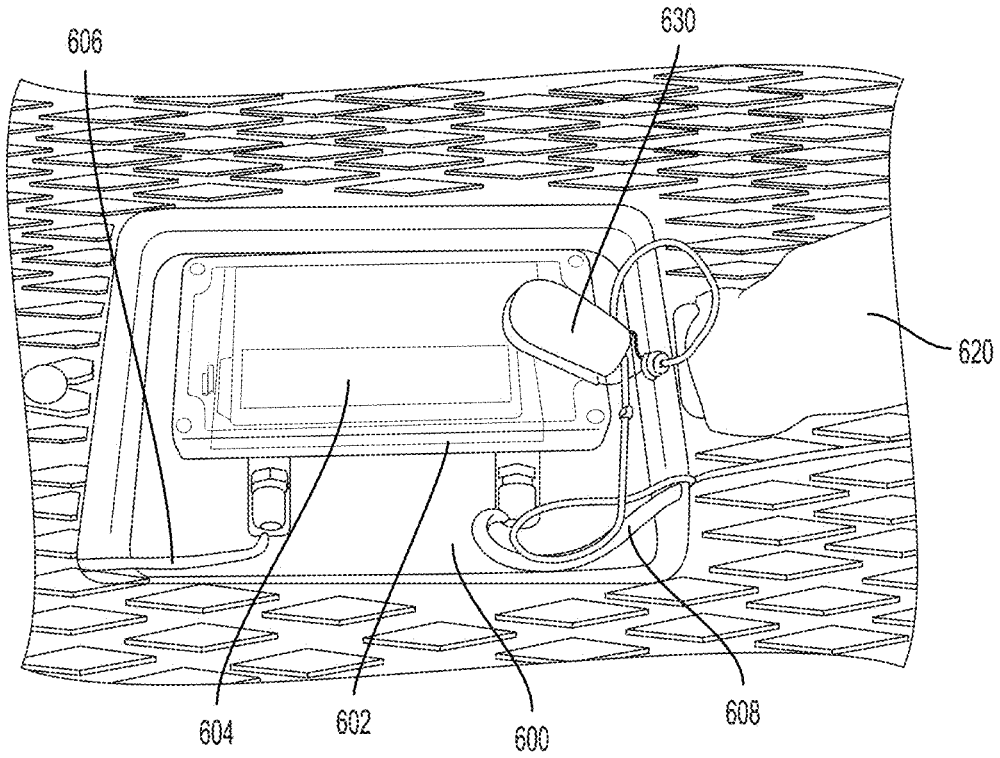
FIG. 6 illustrates an example of a second well within a board of a jetfoiler in accordance with implementations of the present disclosure.

FIG. 6 illustrates an example of a second well 600 within a board of a jetfoiler in accordance with implementations of the present disclosure. The second well 600 can be created directly into a top surface of the board (e.g., the board 400 of FIG. 4 and similar to the first well 500 of FIG. 5). The second well 600 houses an electronics unit 602 that includes a display unit (e.g., LCD or LED) 604, a first communication link 606, a second communication link 608, and a plurality of microcontrollers (not shown). The first and the second communication links 606-608 can comprise wires of a plurality of varying types. Fewer or more than two communications links (i.e., the first and the second communication links 606-608) can be housed within the second well 600.

The first communication link 606 can connect the second well 600 to a first well (e.g., the first well 500 of FIG. 5) and can travel along a trough (e.g., the trough 404 of FIG. 4) within the deckpad (e.g., the deckpad 410 of FIG. 4) of the board. The second communication link 608 can connect the second well 600 to a power system (e.g., the power system 112 of FIG. 1) and can travel along the trough and through a strut slot (e.g., the strut slot 402 of FIG. 4) via a strut (e.g., the strut 114 of FIG. 1) and to the power system. The second communication link 608 can communicate with a motor controller of the power system. The first and second communication links 606-608 can also use wireless communications to transmit data between various components of the jetfoiler (e.g., transmitting data between the electronics unit 602 of the second well 600 and a motor controller wirelessly). Therefore, the first and second communication links 606-608 can be wired communication links or wireless communication links.

The plurality of microcontrollers can include a first microcontroller for transmitting commands that have been generated using information received from the throttle (via operator input). The commands can be transmitted via the second communication link 608 to the motor controller (or another component) of the power system that processes the received commands and controls or alters the operation (e.g., increase/decrease speed) of the jetfoiler. The plurality of microcontrollers can include a second microcontroller for logging information (e.g., ride data, run-time, routes, component temperature, motor rpm, operator attributes, etc.). The second well 600 can include a variety of components including but not limited to a connector to a footstrap 620 (e.g., the at least one footstrap 320 of FIG. 3) and an LCD display 604 and a kill switch 630 that can be coupled to the operator (e.g., via a tether/leash or a proximity sensor that senses when a rider has fallen off) to stop operation of the jetfoiler when the operator falls off the board. In some implementations, the footstrap 620 and the kill switch 630 are not coupled within the second well 600 and are instead coupled to a first well (e.g., the first well 500 of FIG. 5) or to other areas of the board.

A board of the jetfoiler can also be made of a material that enables the board to be inflatable. For example, the board can be made using a drop-stitch construction. The board can be inflated using a variety of pumps (e.g., self-inflation pump that can be housed within or coupled to the jetfoiler) and to a predetermined pressure including but not limited to 15 pounds per square inch (psi). An inflatable board can be easier to transport in comparison to a rigid board (e.g., a board made of carbon fiber and/or foam such as the board 102 of FIG. 1 and the board 400 of FIG. 4). An inflatable jetfoiler board, made out of PVC or a similar material, can combine the contents of the first and second well in order to house them in a rigid, oval-shaped tray made out of carbon fiber or a similar material.

A power system of the jetfoiler (e.g., the power system 112 of FIG. 1) can be housed, in the propulsion pod (as shown in FIG. 1), in the second well located in the board, or in a rigid tray (also referred to as a tray) enclosed by an inflatable board at a top end of a strut (e.g., the strut 114 of the hydrofoil 104 of FIG. 1), thereby enabling use of a hydrofoil and a power system with inflatable boards that come with different sizes and shapes and features. The material of the inflatable board can include a predetermined carve-out designed to accept the tray that is rigid as the board is being inflated. The inflatable board can use an adapter to enable coupling with the hydrofoil (i.e., hydrofoil assembly). The adapter can adapt a sharp-cornered shape of the tray to a rounded elliptical shape that can be more readily embedded into the inflatable board. A sectional profile of the adapter includes a semi-circular internal concavity along its perimeter that allows an inflation pressure of the inflatable board to hold it in place. The tray can be coupled to the inflatable board without using the adapter if the tray is pre-shaped with a rounded elliptical shape that is easier to couple with the inflatable board.

Figure 7A:
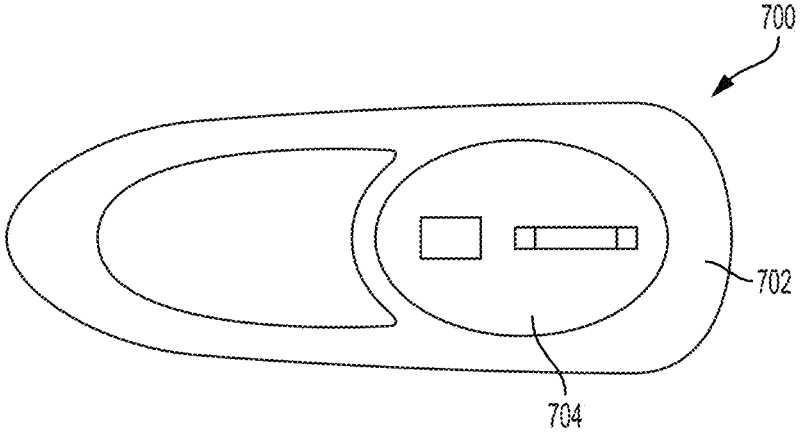
FIG. 7A illustrates a top view of an example of a jetfoiler with an inflatable board in accordance with implementations of the present disclosure.
Figure 7B:
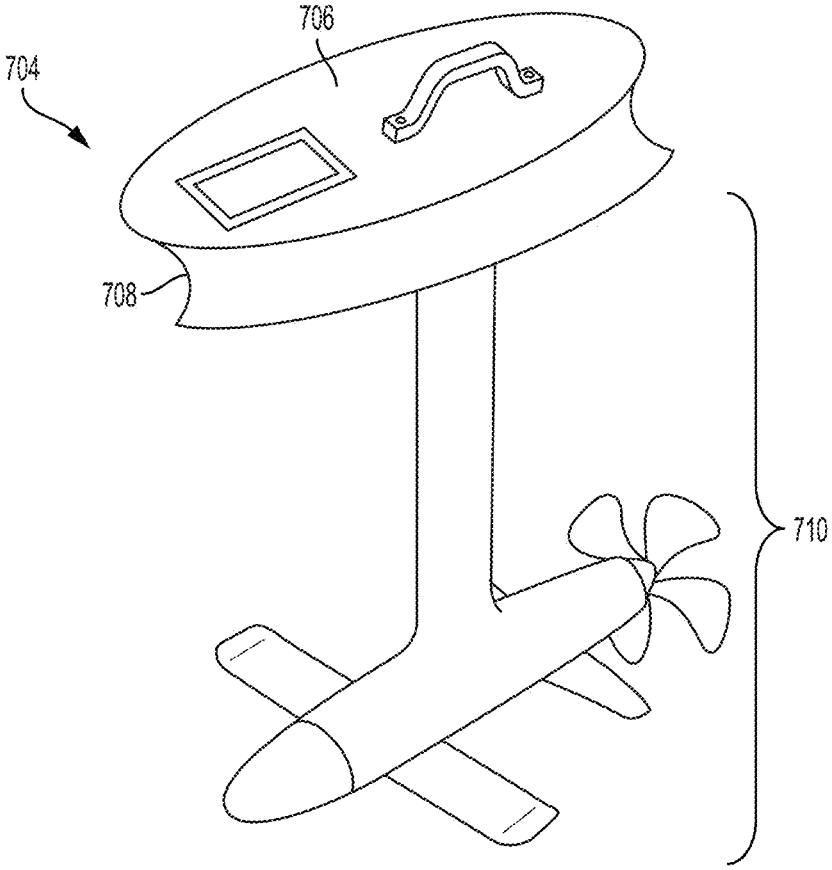
FIG. 7B illustrates an example of a hydrofoil power system of a jetfoiler with an inflatable board in accordance with implementations of the present disclosure.

FIG. 7A illustrates a top view of an example of a jetfoiler 700 with an inflatable board 702 in accordance with implementations of the present disclosure. The jetfoiler 700 includes the inflatable board 702 coupled around a hydrofoil power system 704. In FIG. 7A, only a top portion of the hydrofoil power system 704 is shown. FIG. 7B illustrates an example of the hydrofoil power system 704 of the jetfoiler 700 with the inflatable board 702 in accordance with implementations of the present disclosure.

The jetfoiler 700 can comprise two stand-alone components (one for the inflatable board 702 and another for the hydrofoil power system 704) that can be coupled together. The jetfoiler 700 can also comprise a singular device that includes the inflatable board 702 connected around the hydrofoil power system 704. If the jetfoiler 700 comprises two stand-alone components, they can be reattached and attached (e.g., when the inflatable board 702 is upgraded or has been damaged). It may also be possible to detach the hydrofoil power system 704 from a tray 706 in a similar manner to the hydrofoil/rigid board attachment/detachment. Unlike the inflatable board 702 that includes an inflatable portion and material, the hydrofoil power system 704 can be a rigid device with the tray 706 that can house one or more batteries, part or all of the power system (e.g., the power system 112 of FIG. 1), and an electronics unit including but not limited to any combination of microcontrollers, an LCD display, a safety kill switch. A hydrofoil 710 (e.g., the hydrofoil 104 of FIG. 1) of the hydrofoil power system 704 can be coupled to a bottom surface of the tray 706. As shown in FIG. 7B, the hydrofoil 710 can comprise a strut, a propulsion pod coupled to the strut, at least two wings coupled to the propulsion pod, and a propeller system coupled to the propulsion pod. The propulsion pod may also contain some or all of the power system. The hydrofoil 710 can also contain one wing instead of two or more wings.

Unlike the power system 112 of FIG. 1 that is housed within the propulsion pod (e.g., the propulsion pod 106), the power system of the hydrofoil power system 704 can be housed within the tray 706. The tray 706 can be coupled to an adapter 708 that surrounds the tray 706 and enables the tray 706 to be coupled to the inflatable board 702. The adapter 708 can have a semi-circular internal concavity (or a different type of shape) along its perimeter to enable inflation pressure of the inflatable board 702 to hold in place when the inflatable board 702 is coupled to the hydrofoil power system 704 via the tray 706 if the tray 706 has a sharp-cornered shape. In some implementations, the tray 706 has a semi-circular internal concavity and so the adapter 708 is not required. The tray 706 can include an electronics unit with a display (e.g., the electronics unit 602 of FIG. 6) and a handle for easy transportation. The hydrofoil power system 704 (e.g., via the tray 706) can include an integrated inflation pump that can inflate the inflatable board 702. The inflatable board 702 can be inflated either before or after the coupling together of the inflatable board 702 and the hydrofoil power system 704.

Figure 8:
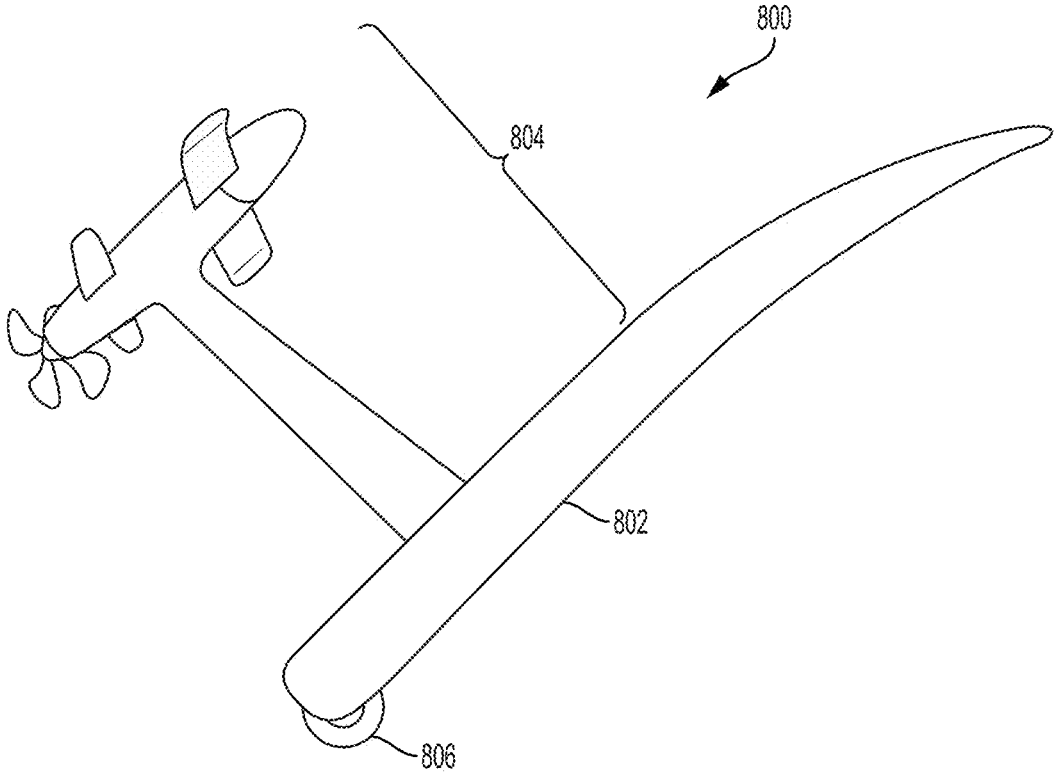
FIG. 8 illustrates an example of a jetfoiler with a wheeled board in accordance with implementations of the present disclosure.

FIG. 8 illustrates an example of a jetfoiler 800 with a wheeled board 802 in accordance with implementations of the present disclosure. The jetfoiler 800 includes the wheeled board 802 coupled to a hydrofoil 804 (e.g., the hydrofoil 104 of FIG. 1). The wheeled board 802 can be similar to the board 102 of FIG. 1 or the board 400 of FIG. 4 with the addition of at least one wheel 806 for easy transportation. The wheeled board 802 can be dragged or carried by an operator/rider while the wheeled board 802 is upside down with the hydrofoil 804 in the air as shown in FIG. 8. In some implementations, the at least one wheel 806 comprises a pair of wheels near a perimeter of a top aft portion of the wheeled board 802. In other implementations, the at least one wheel 806 comprises a single wheel near a center area of the top aft portion of the wheeled board 802. The at least one wheel 806 can be made of a variety of materials (e.g., rubber, cushioned material for beach usage, etc.) and can come in a variety of shapes and sizes and can be positioned within the wheeled board 802 in a variety of locations.

The at least one wheel 806 can be inserted into built-in slots on the top aft portion of the wheeled board 802. The at least one wheel 806 can be removable/detachable or can be embedded within the wheeled board 802 and thus not removable. If the at least one wheel 806 is not removable, it can be retractable so that it can be embedded within the wheeled board 802 and then deployed when ready for usage (i.e., ready to be rolled). If the at least one wheel 806 is removable and can be reattached, the at least one wheel 806 can snap into place or can be locked via another mechanism including but not limited to clipping.

Figure 9:
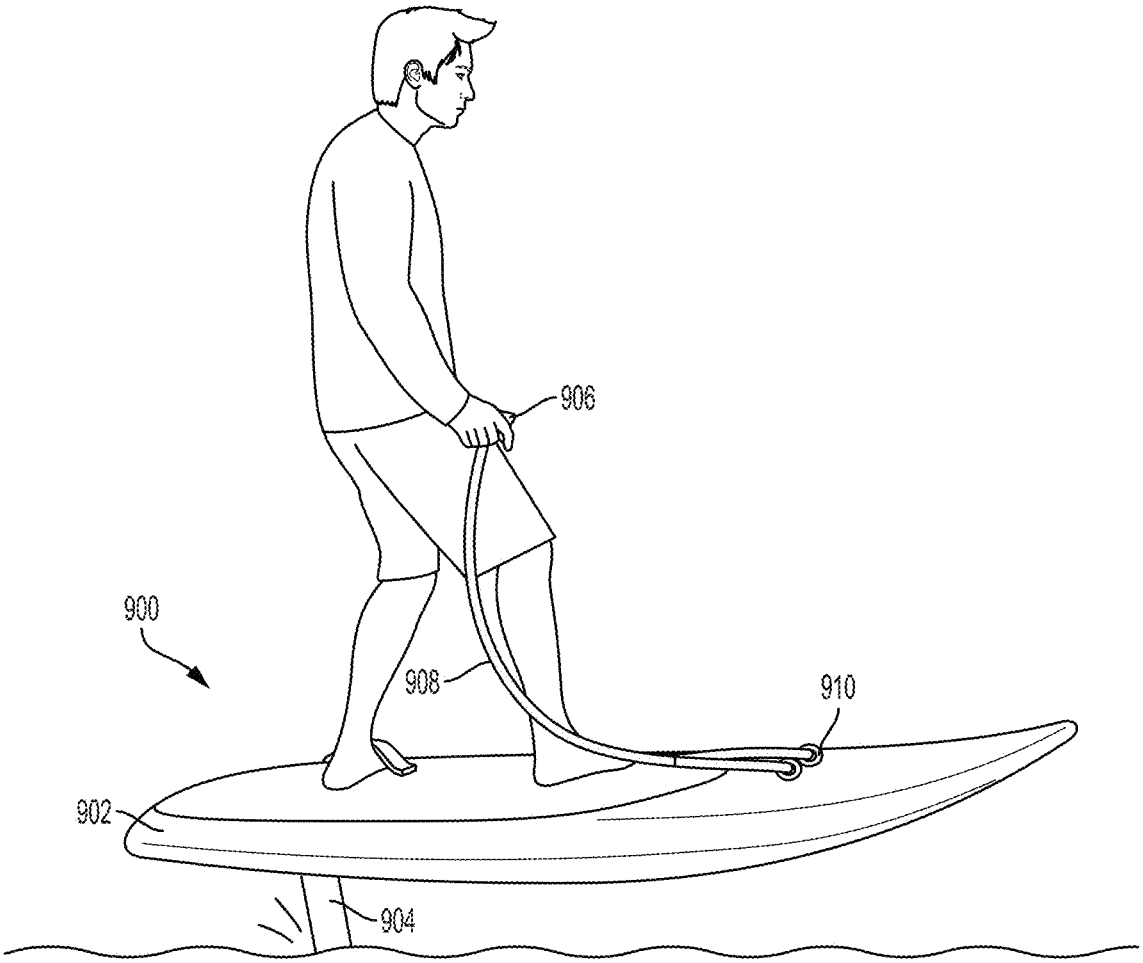
FIG. 9 illustrates an example of a jetfoiler controlled using a throttle system in accordance with implementations of the present disclosure.

FIG. 9 illustrates an example of a jetfoiler 900 controlled using a throttle system in accordance with implementations of the present disclosure. The jetfoiler 900 includes a board 902 (e.g., the board 102 of FIG. 1 or the board 400 of FIG. 4) coupled to a hydrofoil 904 (e.g., the hydrofoil 104 of FIG. 1). An operator (i.e., rider/user) of the jetfoiler 900 can stand on the board 902 while operating the jetfoiler 900 using the throttle system (also referred to as a throttle). In FIG. 9, only a top strut portion of the hydrofoil 904 is shown (i.e., the propulsion pod, embedded power system, and propeller system are submerged under water). The throttle comprises a plurality of components including but not limited to a throttle controller 906 that can be held by the operator and a throttle cable 908 that is coupled to the throttle controller 906 on one end and to the board 902 on another end. The throttle cable 908 connects the throttle controller 906 to the board 902 via at least one anchor point 910 (also referred to as throttle cable-board anchor points). The throttle controller 906 can be a variety of types of controllers including but not limited to a thumb controller, a trigger controller, a wired controller, a wireless controller (e.g., a controller capable of communicating wirelessly, and therefore not using the throttle cable 908), a joystick, and any combination thereof.

The throttle can be adapted to be operated by a thumb or other finger of the operator to control operation (e.g., speed, direction, etc.) of the jetfoiler 900. When the operator engages (e.g., presses) the throttle controller 906, information is produced and the information is transmitted to an electronics unit (e.g., via a microcontroller of the electronics unit) that generates commands or instructions using the information. Before reaching the electronics unit, the information can be transmitted from the throttle controller 906 to a junction box (e.g., the junction box 502 of FIG. 5) serving as an intermediary device that then transmits the information to the electronics unit. The junction box can be an intermediary transmission device or can simply link wires together that are transmitting the information between the throttle controller 906 and the electronics unit. The information can also be transferred wirelessly from the throttle controller 906 directly (i.e., no junction box or similar intermediary device and no throttle cable wire necessary) to the electronics unit. The information can also be transferred in a wired format from the throttle controller 906 directly (no junction box or similar intermediary device necessary) to the electronics unit via the optional throttle cable 908. In response to generating the commands or instructions using the received information, the electronics unit transmits the commands or instructions to a motor controller to control operation of the jetfoiler 900. Therefore, the jetfoiler 900 is controlled using inputs of the operator that are received by the throttle controller 906. For example, if the operator presses a down arrow button of the throttle controller 906 or rocks a dial backward to slow down the speed of the jetfoiler 900, information associated with that action is transmitted to the electronics unit and then processed into a "slow down command" that is transmitted to slow the motor down.

The throttle controller 906 can be similar to an electric bicycle throttle. The throttle controller 906 can be attached to the board 902 via the throttle cable 908 to a location in a front one-third (⅓) of the board 902. The operator may also use the throttle cable 908 for stability while riding. The throttle cable 908 can be designed with no wire splices and as a continuous wire that is soldered directly to a sensor of the throttle controller 906 thereby avoiding shorts or water intrusion that could affect the various inputs (e.g., speed input) provided by the operator.

Wires can serve as a communication link from the throttle controller 906 via the throttle cable 908 and to the microcontroller of the electronics unit (e.g., the first microcontroller of the electronics unit 602 of FIG. 6). For example, a wire can be embedded within or integrated with the throttle cable 908 and can transmit information from the throttle controller 906 to the junction box within a well of the board 902 and then another wire can connect the junction box to the electronics unit with the junction box serving as a connection between the two wires. The microcontroller can translate the received information into commands or instructions that are then transmitted to a motor controller (e.g., an ESC or motor controller of an electric motor of the power system 112 of FIG. 1) to operate the jetfoiler 900. The throttle cable 908 can connect the throttle controller 906 directly to the electronics unit for processing of the information that generates the commands or instructions used by the motor thereby bypassing the need for the junction box. In some implementations, the information produced by the throttle controller 906 in response to operator interaction (e.g., the rider pressing on the throttle controller 906) can be wirelessly communicated either indirectly to a microcontroller in the electronics unit and then to the motor controller or directly to the motor controller. In the case of wireless communication, an additional microcontroller that functions as a transmitter could be housed in the throttle controller 906.

In some implementations, the throttle controller 906 is on a reel leash that allows it to retract into the board 902 and prevents it from being lost. The throttle can be limited to use up to a predetermined percentage (e.g., 75%) of maximum available power to allow the operator more nuances in speed control and to prevent the operator from exceeding safe speeds (e.g., peak speed limits). The throttle can be limited differently depending on whether the board 902 is foiling or not. For example, less power can be available when the jetfoiler 900 is in non-foiling mode (or displacement mode) so that the operator must use proper technique to initiate foiling (or the foiling mode) thereby preserving battery usage and making the foiling transition gentler for the operator. Limiting power may also be used to safeguard against overheating power system components.

If the throttle controller 906 is a wireless controller, the throttle cable 908 can be eliminated as one of the components of the throttle system. A wireless throttle controller may include a leash to tether it to the board 902 or to the operator. The wireless throttle controller can still be coupled to the throttle cable 908 with the throttle cable 908 serving dual functionality both as a rope when its embedded wiring is not serving as a communication link and also as the communication link in certain situations. This would enable operation of the jetfoiler 900 via a wired communication even when the wireless functionality of the wireless throttle controller ceases to function (e.g., when the battery powering the wireless throttle controller has died).

The throttle controller 906 can include a built-in display (in addition to or instead of a display mounted in a well of the board 902). The display provided on the throttle controller 906 can be easier to read because it is closer to the rider. The throttle controller 906 can be used to advise the rider of speed, motor rpm, device health (e.g. battery power, component temperature), and/or riding efficiency or directions using vibrations, lights, text, graphics, noises, or any combination thereof. For example, the throttle controller 906 may vibrate to indicate that the battery power of the jetfoiler 900 is running low or may display a message via the display that indicates that the jetfoiler 900 is drawing too much current.

The throttle may be limited to multiple pre-determined settings, depending on operator characteristics. For example, an operator could choose "beginner", "intermediate", or "expert" modes, depending on his or her particular skill level which could alter the speed thresholds set when using the throttle controller 906. Over time, the levels can also gradually increase so that all users of the jetfoiler 900 must begin at the "beginner" level and that after a certain number of hours (e.g., determined using the ride data), the operator can proceed to the next levels. The throttle can include a safety braking feature (e.g., via the throttle controller 906) to stop a propeller and/or collapse a folding propeller. If the throttle controller 906 is wireless, it may be used to determine whether the operator has fallen (e.g., after a wireless connection such as Bluetooth or another data packet delivery system is lost between the throttle controller 906 and the board 902 because the throttle controller 906 is determined to be more than a predetermined distance away from the board 902) to activate an emergency brake.

The throttle controller 906 can include at least one button or trigger. In some implementations, the throttle controller 906 only includes one button that can be shifted upwards to increase speed, downwards to decrease speed. In other implementations, such a throttle controller may also include functionality to move the button left and right to navigate the jetfoiler 900 (e.g., by shifting wing positioning, weight distribution, rotating an optional rudder, and other features of the jetfoiler 900). In other implementations, the throttle controller 906 includes two buttons as a safety feature, both of which must be activated (e.g., pressed by the rider) to allow the jetfoiler 900 to operate and move. The throttle can also have a reverse mode to actively enable braking by the rider which could slow the jetfoiler 900 down without shutting off the motor.

Figure 10A:
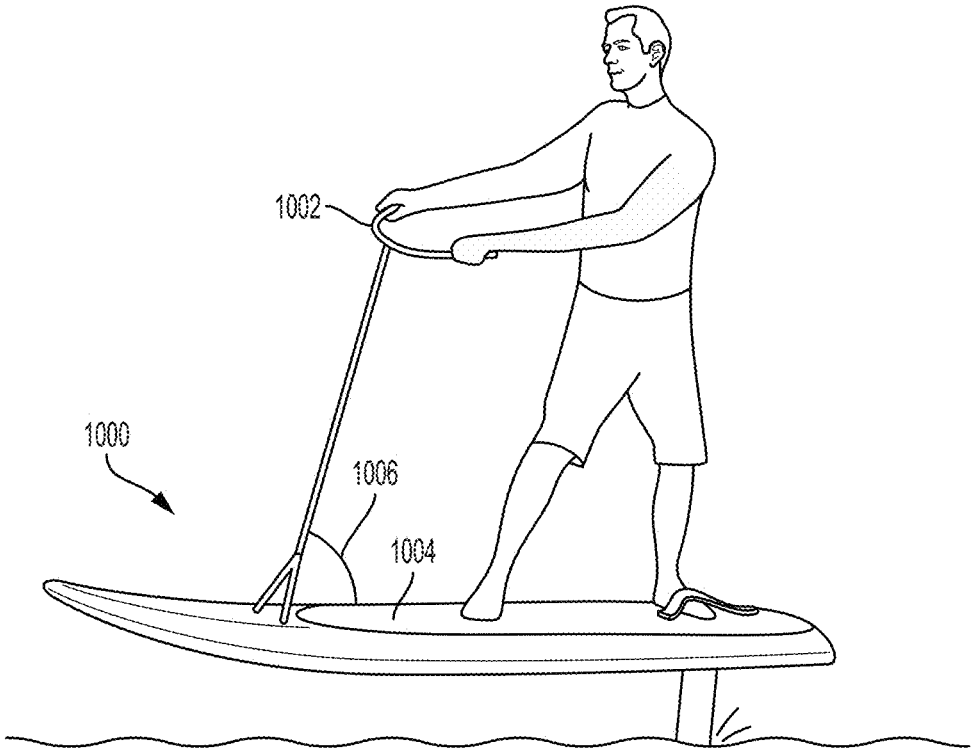
FIG. 10A illustrates an example of a jetfoiler controlled using a handlebar throttle in a first position in accordance with implementations of the present disclosure.

FIG. 10A illustrates an example of a jetfoiler 1000 controlled using a handlebar 1002 in a first position 1006 in accordance with implementations of the present disclosure. The handlebar 1002 comprises a handlebar coupled to a frame (e.g., a rigid pole with a single anchor point or with multiple anchor points) that is coupled to both the handlebar on one end and to a top surface of a board 1004 of the jetfoiler 1000 on another end. The handlebar 1002 may also incorporate a throttle system (e.g., the throttle system of FIG. 9), either by integrating the throttle controller (e.g., the throttle controller 906 of FIG. 9), and throttle controller communication link into the handlebar, or by providing a clip for a wireless controller to be positioned or plugged in (e.g. temporarily made wired) while riding the jetfoiler. An operator of the jetfoiler 1000 can engage the throttle system from the handlebar 1002 to control the jetfoiler 100.

Figure 10B:
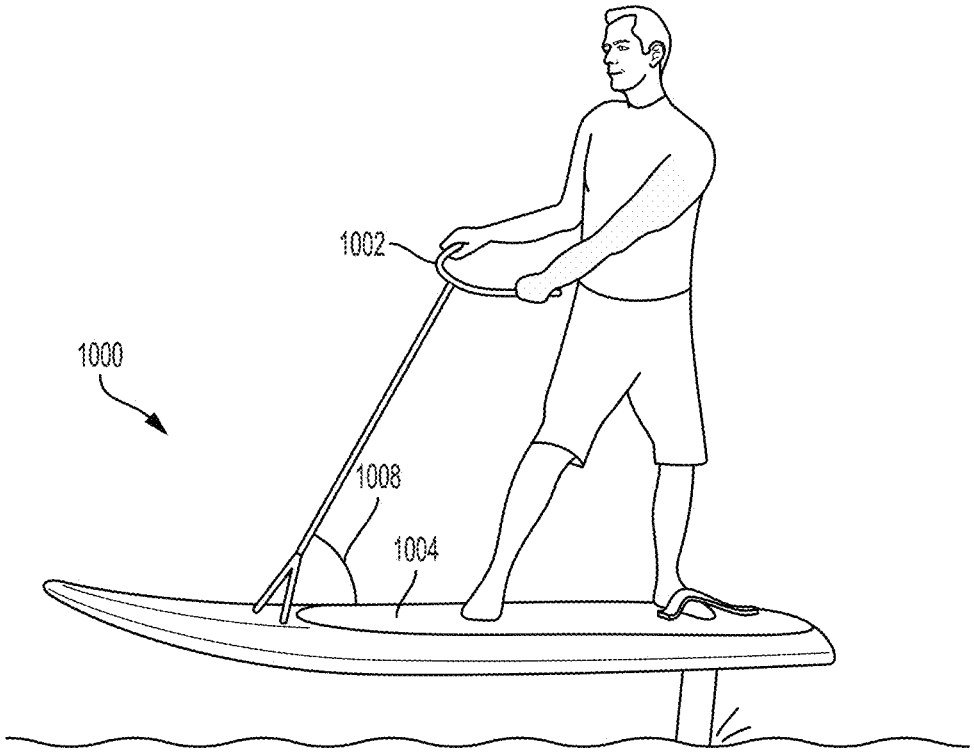
FIG. 10B illustrates an example of a jetfoiler controlled using a handlebar throttle in a second position in accordance with implementations of the present disclosure.

The handlebar 1002 can be moved from the first position 1006 to a plurality of other positions for flexibility. FIG. 10B illustrates an example of the jetfoiler 1000 controlled using the handlebar 1002 in a second position 1008 in accordance with implementations of the present disclosure. The second position 1008 produces a smaller angle between the handlebar 1002 and the board 1004 in comparison to a larger angle produced by the first position 1006. The handlebar 1002 can have an adjustable height to match varying operator heights and can be coupled to the board 1004 via a plurality of mechanisms including but not limited to a hinge, a joint, and a ball and socket connection. Additional components can be coupled to the handlebar 1002 including but not limited to a display and a container that are each coupled either to the handlebar or to the frame.

The handlebar 1002 can provide additional stability for the operator and can make it easier for the operator to influence a direction of the board 1004 while operating the jetfoiler 1000. The handlebar can be mounted to the frame that comprises either a pole that is similar to poles used on scooters or that comprises a flexible A-frame. The components of the handlebar 1002 that include at least the handlebar and the frame can be removable (i.e., detachable and attachable). Both wired and wireless throttle controllers can be made to be removed from the handlebar 1002 and the frame can be removed from the board 1004. In some implementations, the frame has an A-frame shape and uses an hourglass fitting (e.g., made of rubber) to join each leg of the A-frame shape. The frame can include an emergency release on a mechanical hinge or magnetic attachment with the board 1004 to allow the frame to fold and to protect the jetfoiler 1000 and/or the operator in case of impact or accident. The frame may be connected to and integrated with a front area of the board 1004. Additional electronics (e.g., speedometer) may be mounted on or near the handlebar of the handlebar throttle 1002.

Figure 11:
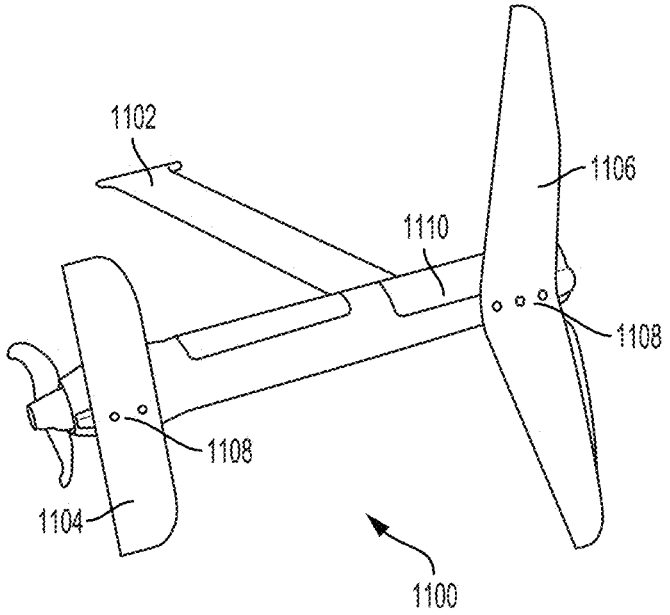
FIG. 11 illustrates an example of a hydrofoil of a jetfoiler in accordance with implementations of the present disclosure.

FIG. 11 illustrates an example of a hydrofoil 1100 of a jetfoiler in accordance with implementations of the present disclosure. The hydrofoil 1100 is similar to the hydrofoil 104 of FIG. 1 and is coupled to a board (e.g., the board 102 of FIG. 1) of the jetfoiler. The hydrofoil 1100 includes a strut 1102 and an aft wing 1104 and a forward wing 1106 coupled via a plurality of wing connection bolts 1108 to a propulsion pod 1110. The hydrofoil 1100 can include fewer or more wings than the aft and the forward wings 1104-1106. The plurality of wing connection bolts 1108 couple the aft wing 1104 and the forward wing 1106 to the propulsion pod 1110 (e.g., similar to the propulsion pod 106 of FIG. 1) that is connected to the strut 1102. The strut 1102 can include at least one wire that can serve as a communication link between the throttle system (not shown) that enables a rider to control the jetfoiler and a motor (e.g., an electric motor of a power system such as the power system 112 of FIG. 1) that controls the jetfoiler using commands generated based on the received rider adjustments from the throttle system.

In some implementations, a communication pathway between a throttle system (operated by the rider) and a motor of the jetfoiler is wired and travels between the throttle controller of the throttle system, a junction box within a well of the board, an electronics unit within a well (e.g., the same well or a different well) of the board, the strut 1102 of the hydrofoil 1100, and the motor of the power system within the propulsion pod 1110. The junction box and the electronics unit can comprise one on-board electronics system as opposed to two separate systems. In other implementations, the communication pathway is wireless and so adjustments to the throttle system by the rider can be directly received wirelessly by the electronics unit, which in turn directs the motor to adjust various aspects of the operation of the jetfoiler (e.g., speed, direction, etc.). The communication pathway can also wirelessly link the throttle system to the motor itself bypassing the need for transmission of information to the electronics unit.

A power system comprising a motor (e.g., an electric motor), a motor controller, and at least one battery can be encapsulated in a faired shape underwater housing comprising the propulsion pod 1110 that is integrated with the hydrofoil 1100. The strut 1102 can run approximately perpendicular to the board of the jetfoiler and may be integrated with the propulsion pod 1110. A top portion or end of the strut 1102 can fit into a strut slot (e.g., the strut slot 402 of FIG. 4) of the board and the strut 1102 can be attached to the board using bolts or a similar mechanism. A location of the strut slot can be in an aft one-fourth (¼) of the board. The strut 1102 can be made of carbon fiber with a foam core, with spacing to enable at least one wire to run through a length of the strut 1102 connecting the power system within the propulsion pod 1110 to electronics coupled to the board and in communication with the throttle controller. The strut 1102 can terminate in the propulsion pod 1110 and the propulsion pod 1110 can make up a horizontal segment of the hydrofoil 1100 between the aft and forward wings 1104-1106.

Figure 12:
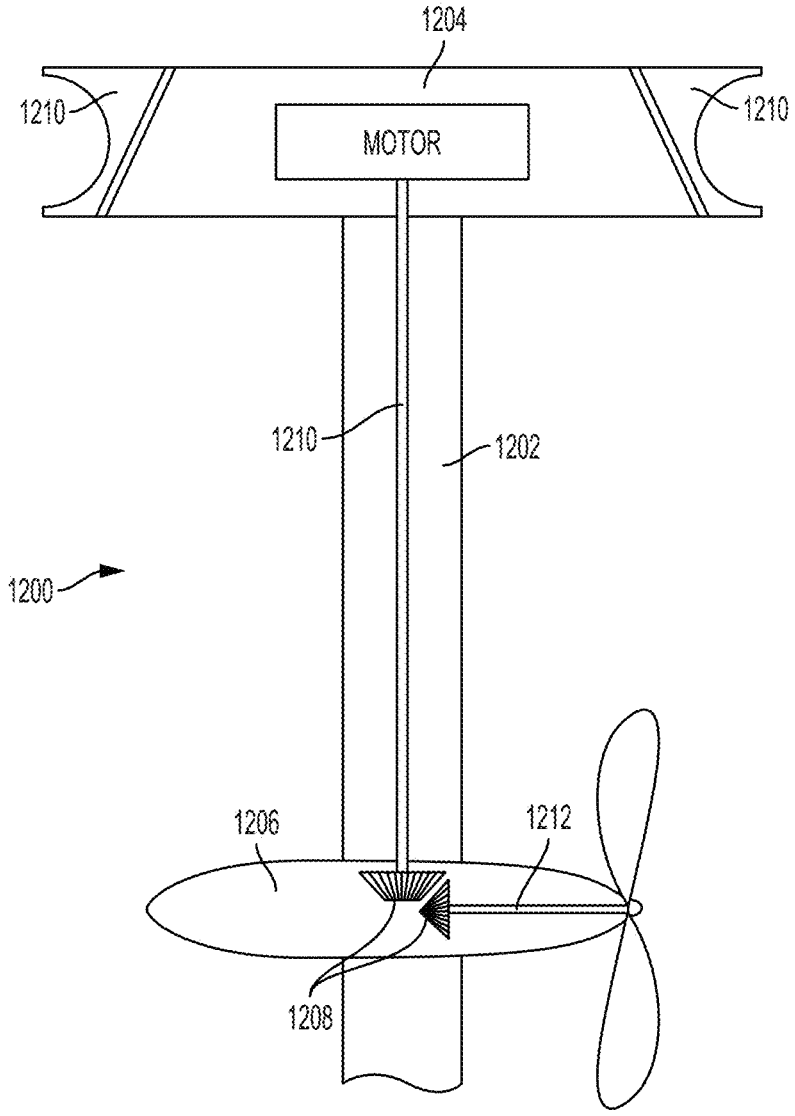
FIG. 12 illustrates an example of a hydrofoil of a jetfoiler in accordance with implementations of the present disclosure.

FIG. 12 illustrates an example of a hydrofoil 1200 of a jetfoiler in accordance with implementations of the present disclosure. The hydrofoil 1200 is coupled to a board (e.g., the board 102 of FIG. 1) of the jetfoiler. The hydrofoil 1200 includes a strut 1202, a tray 1204 coupled to one end of the strut 1202, and a propulsion pod 1206 coupled to the strut 1202. The strut 1202 can extend below the propulsion pod 1206 and can be coupled to a fuselage with wings (not shown) that helps steer and stabilize the jetfoiler. The strut 1202 can have a plurality of dimensions including but not limited to approximately 35 inches×4 inches. The strut 1202 can have a constant chord (e.g., 4.7 inches×0.6 inches). The strut 1202 can be tapered (e.g., to be 4.9 inches long at an end that enters the board and 3.9 inches at an opposite end that joins the propulsion pod 1206). The tray 1204 can be coupled to the board that is rigid or can be coupled to the board that is inflatable by using a specialized adapter 1210 that is similar to the adapter 708 of FIG. 7B.

The tray 1204 can house a power system (e.g., a power system comprising at least a motor, motor controller, battery, etc.) and the propulsion pod 1206 can house a set of gears 1208 and be coupled to a propeller with an optional protective propeller guard surrounding the propeller (e.g., the propeller 108 and the propeller guard 110 of FIG. 1). Such a jetfoiler may also use a board with wells to house the power system, rather than a separate, board-mounted tray. The set of gears 1208 can comprise a bevel gear assembly. A first gear of the set of gears 1208 is connected to a motor stored within the tray 1204 via a driving shaft 1210 (also referred to as a drive shaft) within the strut 1202. A second gear of the set of gears 1208 is connected to the propeller via a propeller shaft 1212 within the propulsion pod 1206 and is in contact with the first gear of the set of gears 1208. As the motor runs (e.g., in response to receiving information from the motor controller to increase speed), the first gear is turned (e.g., at a faster speed) via the driving shaft 1210 which leads to the turning of the second gear thereby turning the propeller via the propeller shaft 1212 to operate the jetfoiler.

The tray 1204 can include a hole (e.g., a predetermined opening) that enables the driving shaft 1210 to pass through the strut 1202 and through the hole for coupling with the motor housed within the tray 1204. The strut 1202 also enables the driving shaft 1210 to pass through via an internal housing area of the strut 1202. The propulsion pod 1206 can be integrated into the strut 1202 at a location above wings (not shown) of the hydrofoil 1200 instead of being adjacent to the wings as in the hydrofoil 1100 of FIG. 11. Therefore, the propulsion pod 1206 is integrated into the strut 1202 at a point closer to the board and a separate horizontal piece can comprise a fuselage (not shown) part of the hydrofoil 1200 to position the wings. The fuselage can run parallel to the board and is coupled to another end of the strut 1202 at roughly a right angle. In some implementations, the strut 1202 may be integrated with the fuselage as one component or the strut 1202 may fit into a slot in the fuselage and be removable.

In another implementation, a hydrofoil of a jetfoiler is coupled to a board, wherein the hydrofoil includes a strut and a propulsion pod coupled to the strut. The strut can extend below the propulsion pod and can be coupled to a fuselage with wings that help steer and stabilize the jetfoiler. The strut can have a plurality of dimensions including but not limited to approximately 31 inches×4 inches. The strut can be directly coupled to a rigid board with one or more wells in it or the strut can be coupled to a tray that is coupled to the board that is rigid or the strut can be coupled to the board that is inflatable by using a specialized adapter that is similar to the adapter 708 of FIG. 7B. The propulsion pod can contain a motor, a gearbox if one is used, and a propeller shaft. The propulsion pod can also contain the motor controller, but the motor controller may be housed in the board instead. The batteries and electronics unit can be housed in the board wells or in the tray, if a tray is used.

The wings can comprise aft and forward wings that are similar to the aft and the forward wings 1104-1106 of FIG. 11. The wings of the hydrofoil 1200 can attach to the fuselage instead of to the propulsion pod 1206. The wings can be attached either as an integrated piece or in a removable way. The wings can be made from carbon fiber and can be designed to be easily removable, replaceable, and spaced differently (e.g., using bolts). The wings provide lift and stability during operation of the jetfoiler. Wing removal can not only be used for repair and replacement purposes (i.e., when a wing is damaged it is replaced), but can also be used to enable one jetfoiler to be used by riders of varying abilities and/or profiles (e.g., different wing types and combinations enable an advanced tall rider and a beginner short rider to use the same jetfoiler). This enables a rider to use the same jetfoiler as he/she increases in expertise level by modifying the wings of the jetfoiler. The wings can come in a variety of shapes including having curved edges that curve upwards and/or downwards (in addition to other curved orientations). The wings can include flaps that provide the curved edges.

Relative angles of incidence of the wings of the jetfoiler and the distance between the aft wing 116 and the forward wing 118 affect whether or not the jetfoiler is set up for "high performance" (i.e., an advanced or expert level rider) or for "low performance" (i.e., a beginner level rider). For example, higher-aspect-ratio wings spaced closer together will yield a higher performance result whereas lower-aspect-ratio wings spaced further apart will yield a lower performance result. A higher performance result means that the board of the jetfoiler will be more maneuverable and faster but that the margin of error for maintaining foiling stability will be lower. A lower performance result means that the board of the jetfoiler will be more forgiving of a rider by over/under correcting for instability and thus would be easier to ride. The positioning of the wings will determine where the center of lift is positioned when the jetfoiler is in foiling mode. Perceived wing location is a consideration when determining the location of the strut slot during jetfoiler manufacturing. When an end user is moving the jetfoiler wings to adjust performance results, it may be desirable to position the forward wing close to the strut or to make other adjustments to position the wings so that the center of lift when the jetfoiler is in foiling mode aligns with the center of buoyancy when the jetfoiler is in displacement mode.

A wave produced by a surface-piercing strut of the jetfoiler (e.g., the strut 114 of FIG. 1, the strut 1102 of FIG. 11, the strut 1202 of FIG. 12) piles up along a backside of the jetfoiler, continuing upward and sideways into the air, creating a spray. Spray drag is a significant portion of the strut's overall drag but can be used to the jetfoiler's advantage. In configurations where some of the power system is not located under water within the propulsion pod of the jetfoiler, the strut spray can hit an optional board heat sink located on a bottom surface of the board to provide cooling of any of the components of the power system of the jetfoiler (e.g. motor controller, batteries). In addition, the power system can be cooled using water coolant that is taken into the strut below the surface of the water and then pumped upward through the strut and to the power system.

A hydrofoil of a jetfoiler (e.g., the hydrofoil 104 of FIG. 1, the hydrofoil 1100 of FIG. 11, the hydrofoil 1200 of FIG.

12) may be detachable from the board (that is either rigid or inflatable) in such a way that multiple boards can be used with one hydrofoil (i.e., the same hydrofoil). The hydrofoil can pivot to fold for storage or transport. The hydrofoil can have movable control surfaces (e.g., adjustable foil flaps coupled to hydrofoil wing areas) that can be adjusted to change sectional shape of the lifting surface for performance considerations (e.g., stability). The movable control surfaces can be coupled to either the aft wing or the forward wing. The movable control surfaces can be coupled to a backend or a frontend of the wings or different areas. The movable control surfaces (i.e., flaps) can span the entire wing or just predetermined portions of the wing. The movable control surfaces can include a pushrod mechanism that actuates flap movement of the movable control surface. Moving an adjustable foil flap (also referred to as a flap or a control flap) that makes up the aft part of a hydrofoil wing (i.e., an aft control flap), for example, will change the sectional shape of the wing. Such a moveable control surface on the aft hydrofoil wing will adjust the trim/pitch of the jetfoiler. For example, if the flap on the aft wing of the jetfoiler can pivot so the trailing edge is pointing downward, the jetfoiler nose with raise, and the jetfoiler will climb upward, higher above the surface of the water. If the flap on the aft wing of the jetfoiler can pivot so that the trailing edge is pointing upward, the jetfoiler nose will point down toward the surface of the water, and the jetfoiler will pitch forward if that flap angle is maintained. Such an aft control flap can be adjusted in a variety of ways including but not limited to an inertial measurement unit (IMU), a "ride height" sensor, a mechanical wand, or a similar mechanism.

An IMU can measure the angle of the board and adjust the flap to maintain a certain board angle, using a gyroscope or similar device. A "ride height" sensor (e.g., an ultrasonic sensor) can measure the distance between the board and the surface of the water and adjust the flap to maintain a certain riding height above the water. A mechanical sensor (e.g., a wand trailing from the nose of the jetfoiler board) can measure waves on the surface of the water and adjust the flap directly using a cable or other mechanical device to cause the jetfoiler to react to the waves and maintain a steady board. A moveable control surface on the forward hydrofoil (i.e., a forward control flap) will adjust the overall "ride height" of the jetfoiler so that the ride height will stay constant but the jetfoiler will ride higher or lower above the surface of the water, according to the position of the forward control flap, which changes the amount of lift generated by the wing. Such a forward control flap can be adjusted by the rider moving a joystick or other control mechanism or by the rider inputting a number that corresponds with a certain height above the water.

In some implementations, aft and the forward wings (e.g., the aft and the forward wings 1104-1106 of FIG. 11) and additional wings of the jetfoiler can also be movable control surfaces that are adjusted in addition to the movable control surfaces comprising adjustable foil flaps. The movable control surfaces can be coupled to the propulsion pod in addition to wings or can be coupled to other areas of the hydrofoil including but not limited to the strut or the propulsion pod itself. The movable control surfaces can be intelligently computer driven (e.g., using a machine learning mechanism that automatically adjusts the movable control surfaces based on various conditions and associated data detected using sensors such as MEMS devices of the jetfoiler) that automatically compensates for speed and rider weight and ability to control (e.g., adjust speed, steer, and/or stabilize) the jetfoiler. The movable control surfaces can also be manually operated/changed by the rider (e.g., using a throttle controller) based on various operator needs.

The jetfoiler can use an accelerometer, a gyroscope, an inertial-measurement unit (IMU), or any other type of feedback loop control device (e.g., other MEMS devices) to provide a self-stabilizing mechanism that stabilizes riding by modulating power from the batteries to stabilize the board during varying conditions (e.g., when the rider requests assistance, or automatically as a response to waves). The stabilization device can also be used to determine if the board has tipped over or has hit something solid which could trigger a response to stop the propeller and the motor from operating and bring the jetfoiler to an emergency stop.

Figure 13:
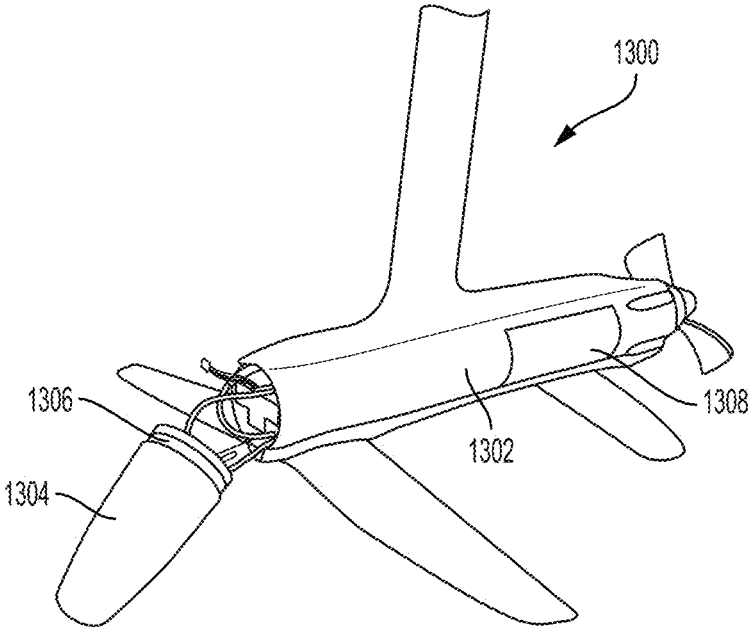
FIG. 13 illustrates an example of a propulsion pod of a jetfoiler in accordance with implementations of the present disclosure.

FIG. 13 illustrates an example of a propulsion pod 1300 of a jetfoiler in accordance with implementations of the present disclosure. The propulsion pod 1300 is similar to the propulsion pod 106 of FIG. 1. The propulsion pod 1300 is coupled to a strut of a hydrofoil (e.g., the hydrofoil 1100 of FIG. 11) of the jetfoiler. The propulsion pod 1300 includes a housing 1302, a nose cone 1304 coupled to the housing 1302 using a nose cone sealing ring 1306 and at least one bolting mechanism or similar mechanism (e.g., a threaded screw attachment), and a heat sink 1308 coupled to the housing 1302. The heat sink 1308 can be an optional component. When the propulsion pod 1300 is made of aluminum, the propulsion pod 1300 can act as a heat sink, dissipating heat. When the propulsion pod 1300 is made of another material (e.g., carbon), it may be desirable to include a heat sink panel made of aluminum or some other material with similar heat dissipating qualities. The nose cone sealing ring 1306 can comprise an aluminum nose cone sealing ring with at least one O-ring (e.g., three silicone O-rings).

At least one camera can be embedded within the nose cone 1304 to enable a rider of the jetfoiler to record underwater during operation of the jetfoiler. The at least one camera can be a variety of different camera types including point-of-view (POV) cameras or 360 degree cameras with zoom capabilities. The at least one camera can be coupled to the nose cone 1304 using a camera clip. The nose cone 1304 can have at least one opening to enable the coupling of the at least one camera using the camera clip. A camera window can be coupled to the nose cone 1304 to protect the at least one camera by serving as an anti-scratch shield and by providing a waterproof seal. The at least one camera can be coupled to other electronics components of the jetfoiler (e.g., an electronics unit coupled within a well of a board of the jetfoiler) via wiring that is also housed within the nose cone 1304 or via wireless mechanisms.

The housing 1302 of the propulsion pod 1300 can also include an access panel to enable access to a power system (e.g., the power system 112 of FIG. 1) that is housed within the propulsion pod 1300. A propeller system comprising a propeller and a propeller guard (e.g., the propeller 108 and the propeller guard 110 of FIG. 1) can also be coupled to the propulsion pod 1300 on an end that is close to the internal power system or another area of the propulsion pod 1300. A close proximity between the propeller system and the power system enables the motor of the power system to more efficiently control the propeller during operation of the jetfoiler. The area of the propulsion pod 1300 that houses the power system that includes a motor can be referred to as a motor housing area of the propulsion pod 1300 that is differentiated from the housing 1302 that represents a main body area of the propulsion pod 1300.

A propulsion pod (e.g., the propulsion pod 106 of FIG. 1 or the propulsion pod 1300 of FIG. 13) is a component of a hydrofoil of a jetfoiler. The propulsion pod is an underwater housing that can have a faired bulb-shape and a hollow interior. The propulsion pod is part of a structure of the hydrofoil and allows a propeller (coupled to the propulsion pod) to join the structure of the hydrofoil in a hydrodynamic way. The propulsion pod is designed to minimize drag and wetted area while remaining large enough to house necessary components which may include but are not limited to cameras, power systems, and associated wiring. To minimize drag while retaining a shape that is simple to manufacture, a forward section of the propulsion pod can have an elliptical shape while an aft section can have a smooth arc.

Figure 14:
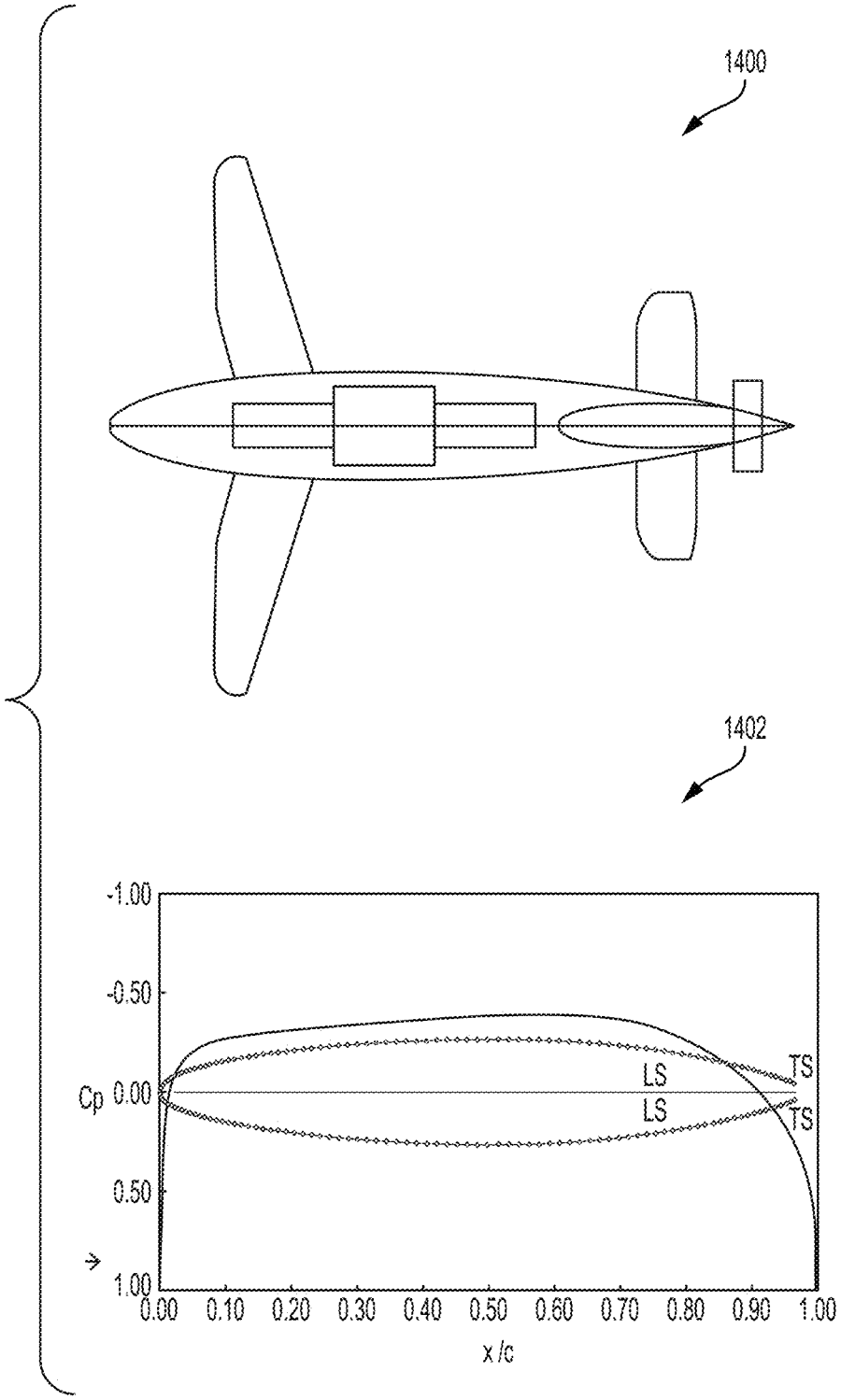
FIG. 14 illustrates an example of an optimized propulsion pod shape in accordance with implementations of the present disclosure.

The shape of the propulsion pod can be determined by seeking a pressure distribution that smoothly increases with no spikes for as far aft as possible and that then smoothly recovers. The pressure distribution can be determined using a pressure distribution curve that is used to determine optimal propulsion pod shape that is rendered using the optimized propulsion pod shape. The chosen propulsion pod shape can be varied based on a variety of factors including but not limited to rider information (e.g., weight and skill level) and jetfoiler performance requirements. FIG. 14 illustrates an example of an optimized propulsion pod shape 1400 in accordance with implementations of the present disclosure. The optimized propulsion pod shape 1400 is determined for graphical rendition using a pressure distribution curve 1402.

If the propulsion pod has a more cylindrical shape with a nose cone and a tail cone, it can cause a low pressure spike where the cylinder and the cones meet. A shape that has a more continuous curve, like that shown in FIG. 14, can produce less hydrodynamic drag, even though it is larger in volume, because it does create such a low pressure spike. It may not be practical for manufacturing purposes to make an optimized propulsion pod shape, because creating that curve might add more weight. For example, if the propulsion pod is made out of aluminum, made out of a material with more heat insulation, or made out of carbon and foam core materials, a streamlined airfoil shape might be heavier or more challenging to manufacture than a cylindrical shape.

Accordingly, the optimized propulsion pod shape 1400 can be more determined by the diameter and length of the pod components (e.g., the motor and potentially the gearbox and motor controller). An arrangement of propulsion pod components can determine an optimal balance between streamline airfoil shape and sustained cylindrical shape. The positioning of the propulsion pod vis-à-vis the strut is also affected by hydrodynamic concerns. Placing the propulsion pod directly under the strut or forward of the strut, rather than aft of the strut, may make the jetfoiler easier to turn as it moves the propeller closer to the strut, and the strut acts as a pivot point of the jetfoiler. If the propeller is positioned too close to the strut, however, it may cause an undesirable pressure spike, effectively making such a design a greater source of drag.

The entire power system of the jetfoiler can be housed within the propulsion pod which contributes to rider stability by consolidating weight below the surface of the water, rather than adding more weight within the board of the jetfoiler. Housing components of the power system (e.g., motor, motor controller, battery, etc.) adjacent to one another provides a more efficient system with shorter wiring runs between the various components. The propulsion pod can be made of carbon fiber with a detachable nose cone (e.g., the nose cone 1304 of FIG. 13) and foil attachment hard points. In some implementations, the propulsion pod includes short pylons that allow wings (e.g., aft and forward wings) to be mounted below the propulsion pod and therefore, below the propeller. The propulsion pod can include an access panel for ease of changing the internally housed components. A heat sink (e.g., the heat sink 1308 of FIG. 13) can be coupled to the propulsion pod that also provides access to the internal housing. When closed, the heat sink can be in direct contact with the motor controller to dissipate heat into the water and to prevent the motor controller from overheating.

The detachable nose cone provides a hydrodynamic shape and an access point to insert and remove internal components of the propulsion pod such as the battery. The propulsion pod can eliminate the need for the access panel by using the access provided by the detachable nose cone. The nose cone can have a built-in POV camera that is held in place behind a camera window using a camera clip. The nose cone includes a rotation detail that allows the nose cone to lock in different orientations for different camera positioning. The propulsion pod can have a plurality of dimensions including but not limited to approximately 34 inches×6 inches×4 inches.

In some implementations, the propulsion pod is coupled to the strut of the hydrofoil high above the wings, instead of acting as an attachment point for the wings. Mounting the propeller higher than the wings results in the propeller exiting the water before the wings if the rider foils too high. The propulsion pod can also house fewer power system components to make it lighter and smaller with less wetted area. For example, the propulsion pod can house a gear assembly (e.g., the set of gears 1208 of FIG. 12) to translate motor rotation into propeller rotation enabling the electric motor and the battery and associated components to be mounted to the board via a tray (e.g., the tray 1204 of FIG. 12), where a driving shaft (e.g., the driving shaft 1210 of FIG. 12) can extend from the motor through a passage in the strut to the set of gears to drive the propeller via a propeller shaft (e.g., the propeller shaft 1212 of FIG. 12).

Alternatively, in other implementations, the propulsion pod that is coupled to the strut of the hydrofoil above the wings, can house part of the power system (e.g., motor, gearbox, etc.), rather than the whole power system and rather than the gear assembly. When using a smaller propulsion pod to reduce wetted area and place the propeller above the hydrofoil wings, part of the power system can be housed in the board. While placing the heaviest components (e.g., batteries) in the propulsion pod may make the jetfoiler more stable to ride, placing weight in the board also has advantages. For example, more weight in the board/less weight in the propulsion pod can make the jetfoiler easier to turn. Adding more components to the board does not increase the board size, but adding components to the propulsion pod can increase the propulsion pod size. The propulsion pod may be positioned so that the bulk of its mass is forward of the strut, aft of the strut, or directly in line with the strut. The positioning of the propulsion pod vis-à-vis the strut will affect the proximity of the propeller to the strut and the weight distribution of the propulsion pod, both of which will affect rider positioning. Instead of being coupled along the strut, the propulsion pod can also join the hydrofoil at another point along a fuselage including but not limited to above an aft wing of the jetfoiler.

The propulsion pod can have an integrated air-circulating bilge pump to cool the motor and/or motor controller and to remove any water that may have entered during operation. Linear water sensor strips can be coupled throughout the propulsion pod or the tray that houses the power system or other areas of the jetfoiler to detect water intrusion. The placement of the linear water sensor strips can be near seams and seals and along bottom surfaces of the propulsion pod and/or the tray. If water is detected, a battery contactor can open and trigger an indication of error on a display (e.g., the display unit 604 of FIG. 6) which can shut down the jetfoiler. Water pressure sensors can also be coupled to the propulsion pod to detect a depth of the propeller. The depth information can be used to detect a "ride height" of the board of the jetfoiler. The water pressure sensors can be used to modulate power coming from the motor to keep the hydrofoil from ventilating thereby preventing the jetfoiler from spinning out of the water. The propulsion pod can be pressurized by a pressurization machine to check for leaks. Pressure sensors can be provided to measure the pressure produced and a smart system can be provided within the jetfoiler to advise the operator/rider regarding whether the pressure measured holds the jetfoiler within the water and the jetfoiler is thus safe to put in the water for operation.

In some implementations, a propulsion pod that houses part of the power system (e.g., motor, gearbox, motor controller, etc.) can be made of a material such as aluminum that dissipates heat, so that the whole propulsion pod acts as a heat sink, cooling the inside components as the jetfoiler passes through water. Alternatively, the propulsion pod may be made from carbon fiber or a similar material and have a heat sink panel, similar to the propulsion pod 1300 of FIG. 13. The propulsion pod may also include some components of the electronics unit including but not limited to a microcontroller (e.g., a microcontroller used to monitor propulsion pod temperature). The propulsion pod can be smaller in size and can have a variety of sizes including but not limited to a size of 13.5 inches in length and 2.5 inches in diameter. Size and shape can be determined by interior components (e.g., motor diameter, whether or not motor controller or microcontroller is included), but may also be determined by hydrodynamic concerns such as pressure distribution.

In addition, the propulsion pod can utilize a threaded mechanism to allow both the nose cone and the motor housing to screw on and off of the central unit or main body of the propulsion pod. The propulsion pod can use O-rings (e.g., silicone O-rings) to make the threaded connections watertight. This can improve ease of servicing and assembly of the propulsion pod by providing easier access to propulsion pod components and by making it easier to assemble parts (propulsion pod, motor, motor controller) made in different factories. The central unit of the propulsion pod may have faired attachment points on both or either the top and bottom of the propulsion pod, to allow the propulsion pod to detach from the strut. This can be used only for ease of manufacturing, where the propulsion pod is made from a different material than the strut (e.g., aluminum and carbon fiber, respectively), and each could be made in a different factory and then assembled, perhaps permanently together. Alternatively, the propulsion pod can be detachable as a feature for end users, for ease of servicing the jetfoiler parts separately and to allow riders to use different propulsion pods (and thus, different motors) with the same strut, or different struts with the same propulsion pod, in order to have riders with different abilities or personal characteristics use the same device.

Figure 15A:
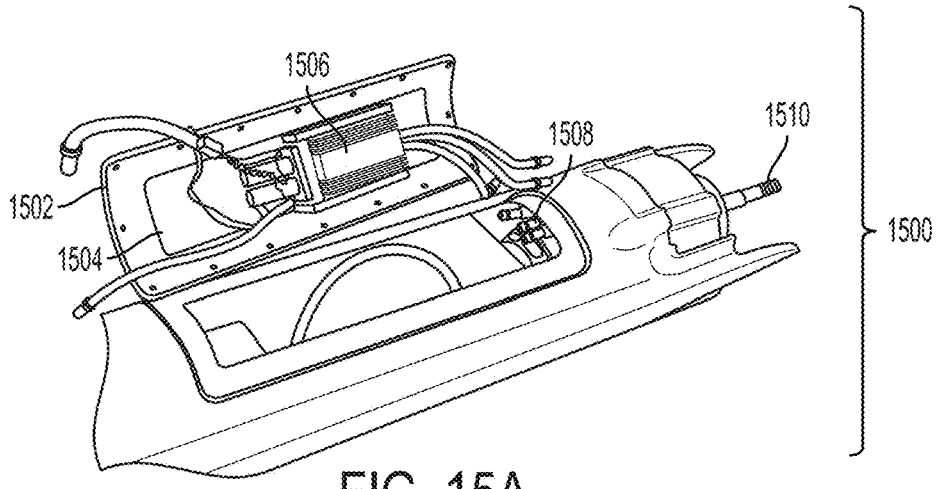
FIG. 15A illustrates an example of a power system of a jetfoiler in accordance with implementations of the present disclosure.

FIG. 15A illustrates an example of a power system 1500 of a jetfoiler in accordance with implementations of the present disclosure. The power system 1500 can be housed within a propulsion pod of a hydrofoil of the jetfoiler (e.g., similar to the power system 112 of FIG. 1) or the power system 1500 can be housed within a tray coupled to a strut of the hydrofoil of the jetfoiler (e.g., similar to the power system within the tray 1204 of FIG. 12) or the power system 1500 can be housed within a well of the board. The power system 1500 includes an access panel 1502, a heat sink 1504 coupled to the access panel 1502, a motor controller 1506 coupled to the heat sink 1504, a motor system 1508 coupled to the motor controller 1506, and a propeller shaft 1510 coupled to the motor system 1508. In some implementations, the power system 1500 does not include either the access panel 1502 and/or the heat sink 1504 and in other implementations, the heat sink 1504, the motor controller 1506, and a battery may be housed elsewhere (e.g., in the board) from the motor system 1508 and a propeller shaft (e.g., in the propulsion pod). The motor system 1508 can comprise a motor coupled to and powered by a battery, and a gearbox coupled to the motor for increasing the torque of the motor. The motor system 1508 is controlling a propeller (e.g., the propeller 108 of FIG. 1) via the propeller shaft 1510. The motor of the motor system 1508 can comprise any of an electric motor, a gas-powered motor, a solar-powered motor, other types of motors, and any combination thereof.

The motor controller 1506 can be located inside the propulsion pod, aft of the motor of the motor system 1508, in contact with the heat sink 1504, and adjacent to the battery. The motor controller 1506 can also be located inside the propulsion pod, aft of the motor of the motor system 1508, that is made of aluminum or a similar material so that the whole pod acts as a heat sink. The motor controller 1506 can also be located inside the board, in the second well or in the tray with adapter, adjacent to a heat sink. The power system 1500 can also include one or more sensors including but not limited to digital temperature sensors which can be coupled to the motor, the motor controller 1506, the battery or batteries, and other components of the power system 1500 to gauge various temperatures and to determine whether the components are working properly. The temperatures that the digital temperature sensors detect can be shown on a display (e.g., the display 604 of FIG. 6) of the jetfoiler or on a display on the throttle and can appear in test logs (e.g., test logs that are part of the ride data). The digital temperature sensors can also be used to trigger warning signals or a device shut-off of either the jetfoiler or various components of the jetfoiler (e.g., electronics) for rider safety.

The propeller shaft 1510 can exit the motor system 1508 and can accept a propeller of the propeller system. The propeller shaft 1510 is supported by bearings that are capable of taking thrust and other loads that the propeller can generate. The propeller shaft 1510 can also take loads generated by a driving shaft (e.g., the driving shaft 1210 of FIG. 12). Propellers of different sizes and shapes can be attached to the propeller shaft 1510.

Figure 15B:
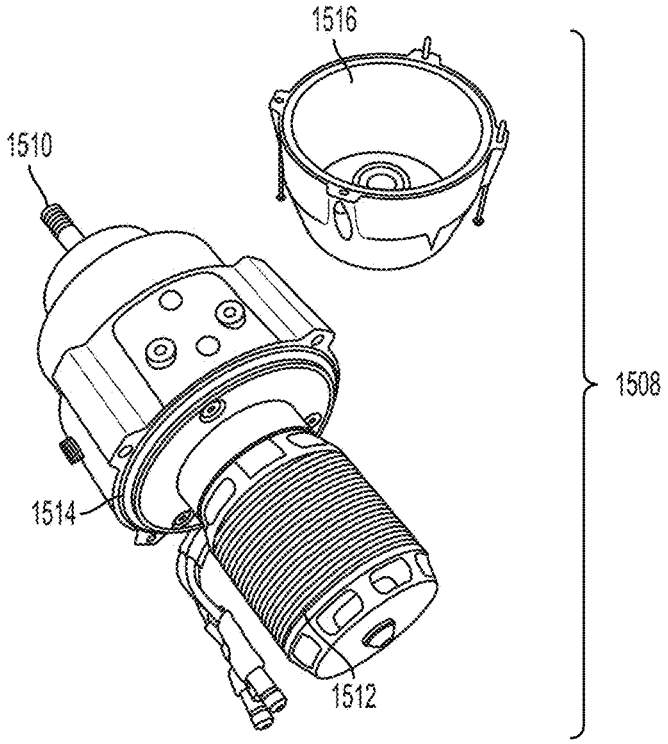
FIG. 15B illustrates an example of a motor system of a power system of a jetfoiler in accordance with implementations of the present disclosure.

FIG. 15B illustrates an example of the motor system 1508 of the power system 1500 of the jetfoiler in accordance with implementations of the present disclosure. The motor system 1508 includes a motor 1512, a gearbox 1514 coupled to the motor, and the propeller shaft 1510 coupled to the gearbox 1514. The motor 1512 is housed within a motor housing 1516 (shown separately). The motor housing 1516 surrounds the motor 1512 for protection. The gearbox 1514 increases the torque of the motor 1512 while reducing rpm. Use of the gearbox 1514 provides more motor options, which can assist with, for example, propulsion pod size requirements, which may determine motor dimensions. In some implementations, the motor system 1508 does not include the gearbox 1514 and the motor 1512 directly controls the propeller system. For example, a high torque/lower rpm constant ($K_v$) motor can be used to drive the propeller using less or no gearing (e.g., 200 $K_v$ motor, no gearbox).

The motor system 1508 can be activated or controlled by receiving instructions from the motor controller 1506 to control the propeller of the propeller system. For example, when an operator of the jetfoiler presses a throttle controller, information (e.g., increase speed of the jetfoiler) is generated and processed into a command (e.g., processed by an electronics unit coupled to a board of the jetfoiler) that is then transmitted to the motor controller 1506. Once the command is received by the motor controller 1506, the motor controller 1506 controls operation of the motor 1512 thereby turning the operation of the propeller system. If the command received by the motor controller 1506 comprises increasing jetfoiler speed, the motor 1512 will adjust to speed up the spinning of the propeller thereby enabling the jetfoiler to go faster.

The motor system 1508 can also include a battery system comprising one or more batteries for powering the motor 1512. The battery system can include a sliding battery that is coupled to a battery sled for easy sliding into the propulsion pod and for connection to both the motor controller 1506 and the motor 1512. The battery sled allows a user to easily remove the battery for charging and to reinsert the battery without having to reconnect battery wires directly to the motor controller 1506 and/or the motor 1512. The battery sled can be made from carbon fiber, can include control wires, and can have an integrated self-locating connector on its aft end. The self-locating connector can have a cone shape which helps guide the self-locating connector into place as the battery sled is inserted into the propulsion pod. Once the battery sled is inserted into the propulsion pod, the integrated self-locating connector connects the battery (and/or the control wires) to circuitry of the motor controller 1506 and/or the motor 1512.

Figure 15C:
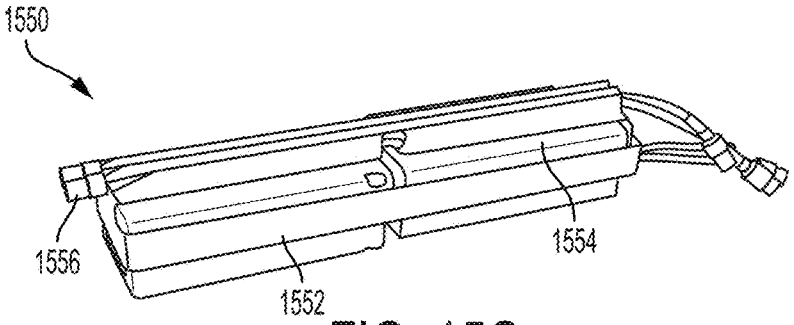
FIG. 15C illustrates an example of a battery system of a motor system in accordance with implementations of the present disclosure.

The battery sled can load with batteries upright when the jetfoiler is on its side. This orientation facilitates a battery swap performed by a single person and/or a battery swap performed on a moving surface like a boat dock because the jetfoiler is stably positioned on its side without any specialized equipment. FIG. 15C illustrates an example of a battery system 1550 of the motor system 1508 in accordance with implementations of the present disclosure. The battery system 1550 includes a battery sled 1552, a battery 1554 coupled to the battery sled 1552, and a self-locating connector 1556 coupled to an end of the battery sled 1552. The self-locating connector 1556 connects the battery 1554 to circuitry of the power system 1500. More than one battery can be coupled to the battery sled 1552.

In some implementations, and referring to FIGS. 15A-15C, the motor controller 1506 can be a 160 A motor controller, the motor 1512 can be a 500 $K_v$ motor running at 58 V, the gearbox 1514 can be a 4:1 gearbox or a 8:1 gearbox, the battery 1554 of the battery system 1550 can comprise two lithium polymer (LiPo) batteries connected in series using 8- or 10- or 12-gauge battery wire. The power system 1500 comprises the motor system 1508 and the battery system 1550 and can be housed in a tray of the hydrofoil or a well of the board instead of being housed within the propulsion pod. The battery system 1550 can include other types of batteries including but not limited to a lithium iron phosphate (LiFePO4) or lithium ion (Lilon) batteries or any combination thereof.

In some implementations, instead of removing the battery sled (e.g., the battery sled 1552 of FIG. 15C) to enable charging of the one or more batteries (e.g., the battery 1554 of FIG. 15C), one or more batteries can be locked into any of the propulsion pod, the board, and the tray of the hydrofoil (also referred to as a foil tray). The user could then plug the entire jetfoiler into a charging device for charging of the one or more batteries. This configuration provides a safety advantage as the user does not need to handle the batteries, but it adds complexity to the charging process since the entire jetfoiler needs to be transported for charging. This configuration also prevents an operator/rider from conducting long riding sessions or swapping riders, which may require mid-session battery changes while on the water. In other implementations, the battery system is housed above the water (e.g., within a well of the board of the jetfoiler or within a foil tray of the jetfoiler) and is connected via battery wires through the strut and to the motor system 1508. This would enable easy changing and charging of the one or more batteries. An auxiliary battery in addition to the one or more batteries of the battery system can be provided within the jetfoiler (e.g., within the board) to serve as a spare battery when the one or more batteries of the battery system need to be swapped out or replaced.

The one or more batteries of the battery system can be housed in the propulsion pod in a way that is more contained in comparison to housing the one or more batteries within the battery sled while still providing for removal of the one or more batteries from the hydrofoil. For example, battery packs can be configured with a safety feature that does not allow the battery packs to be activated until a signal has been received. The signal can be sent to activate the battery pack after the jetfoiler has checked water sensors and other safety sensors and operation of the jetfoiler is authorized. The battery packs can be used for the jetfoiler and can be used with other devices similar to the jetfoiler.

The jetfoiler can include various messaging for states (i.e., "OK" status messages) of the motor controller (e.g., the motor controller 1506 of FIG. 15A) and the battery (e.g., the battery 1554 of FIG. 15C) and other components of the power system 1500 to determine whether the power system 1500 or any of its components are functioning normally. For example, the motor controller and the battery can monitor and exchange status messages internally via a serial data link. If the battery loses contact with the motor controller, a battery contactor coupled to the battery can be opened. When the battery contactor is opened, the battery cannot power the motor and so operation of the jetfoiler will cease. Thus, any time that the battery is not plugged into a working motor controller (i.e., when the battery loses contact with the motor controller), the jetfoiler can be configured so that the battery does not output any significant voltage so that the jetfoiler can be launched in the water without any issues (i.e., issues can arise if the battery is powering the motor while a user is loading the jetfoiler into the water). In some implementations, the user can activate a loading mode (e.g., using the throttle system or removing an emergency stop (e-stop) key) that disables the motor controller while the user loads the jetfoiler into the water.

A ground-fault detector can also be implemented into the jetfoiler to check for continuity between battery leads of the battery and a carbon body of the hydrofoil. There should be no continuity which could lead to current flow potentially running through the water and to the rider. Therefore, if continuity is detected, the battery contactor can once again be opened and an error message can be generated on the display which can persist until the continuity issue is resolved with verification (e.g., the ground-fault detector verifies no continuity) or manually cleared by the user. In addition, an electric current sensor can be used to measure power consumption of the jetfoiler and to stop the motor (e.g., the motor 1512 of FIG. 15B) if there is a locked or damaged rotor. The electric current sensor can be used to detect when the motor is trying to spin in free air which would produce a low current and a high speed (instead of spinning in the water as desired) thereby stopping or limiting the motor. The low current and high speed levels can be determined using predetermined thresholds.

Figure 16:
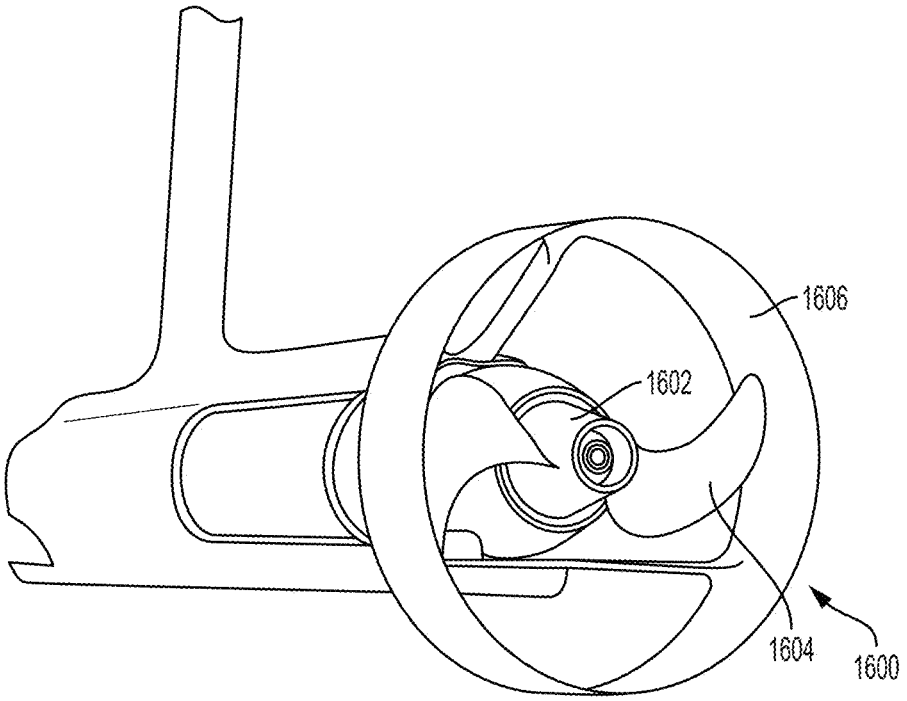
FIG. 16 illustrates a propeller system of a jetfoiler in accordance with implementations of the present disclosure.

FIG. 16 illustrates a propeller system 1600 of a jetfoiler in accordance with implementations of the present disclosure. The propeller system 1600 includes a propeller 1602 comprising two or more propeller blades 1604 and a propeller guard 1606 surrounding the propeller 1602. The propeller 1602 can have a variety of dimensions including but not limited to a diameter of 4 to 16 inches. The propeller system 1600 can be coupled to a propulsion pod (e.g., the propulsion pod 106 of FIG. 1 or the propulsion pod 1300 of FIG. 13) that is in turn coupled to a strut of a hydrofoil or hydrofoil strut (e.g., the strut 114 of the hydrofoil 104 of FIG. 1 or the strut 1102 of the hydrofoil 1100 of FIG. 11) of the jetfoiler. The propeller 1602 and the propeller guard 1606 can be separately coupled to the propulsion pod or the propeller guard 1606 can be coupled to the propeller 1602 that is coupled to the propulsion pod via an attachment mechanism. The propeller guard 1606 may also be integrated into the propulsion pod or the hydrofoil wings.

The two or more propeller blades 1604 attach to the propulsion pod via a propeller shaft (e.g., the propeller shaft 1510 of FIG. 15A). The propeller 1602 can be mounted either forward or aft of the propulsion pod and either forward or aft of the hydrofoil strut. The propeller 1602 can be optimized for a predetermined knot (e.g., 15-knot) cruise performance with a predetermined input power (e.g., 3725 watts or approximately 5 horsepower) at a predetermined propeller rpm (e.g., 4000 propeller rpm). In some implementations, the jetfoiler can include a ducted propeller with a shape that tailors a pitch distribution of the ducted propeller instead of the propeller system 1600. The ducted propeller includes a propeller that is fitted with a water intake nozzle that is non-rotating and increases the efficiency of the propeller. The ducted propeller can be positioned either above or below a fuselage and wings of the hydrofoil.

The propeller guard 1606 can act as a safety feature. The propeller guard 1606 can be bolted to a top and bottom surface (or to only one surface) of the propulsion pod, extending past the motor housing and shielding the two or more propeller blades 1604. The propeller guard can function as a duct to provide the ducted propeller and is tailored to the propeller system 1600 to increase efficiency and operation of the jetfoiler. The propeller guard 1606 can improve efficiency of the propeller system 1600 at low speeds (e.g., below approximately 10 knots). The propeller guard 1606 can have a varied section to provide lift/stability and can function as an aft hydrofoil wing. The propeller guard 1606 can have a variety of dimensions including but not limited to approximately an 8-inch diameter.

The jetfoiler can spin the propeller 1602 in different directions, depending on rider style (e.g., one style for "goofy" and another for "regular" riding styles). In the absence of other forces, a board of the jetfoiler will roll in a direction opposite of the direction that the propeller 1602 is spinning, and the operator/rider must react to that force by pushing down with the rider's weight to stabilize the board. As the rider accelerates or operates the jetfoiler to go faster, the rider has to push down more to balance these forces. It is ideal for rider comfort to enable the rider to push with toes instead of heels and so the toes (instead of the heels) can be positioned near an edge of the board via a footstrap mechanism or another strapping mechanism.

When spinning the propeller 1602 in one direction, the jetfoiler will be easier to ride for a certain rider style and harder to ride for the opposite rider style. The larger the propeller 1602 and the more torque applied by a motor (e.g., the motor 1512 of FIG. 15B) of the jetfoiler, the more pronounced the effect of the spinning direction of the propeller 1602 on rider ease of use. The jetfoiler can include an option to change the spinning direction of the propeller 1602 to make it possible for riders of numerous styles (e.g., "goofy", "regular", etc.) to use the same jetfoiler with a comfortable stance. The option can be controlled via a throttle controller engaged by the rider (e.g., switching a setting from one style to another when starting the jetfoiler) and that is in communication with a motor controller (e.g., the motor controller 1506 of FIG. 15A) via an electronics unit (e.g., the electronics unit 602 of FIG. 6). Based on received information or commands, the motor controller can change the direction of the spinning of the propeller 1602 by changing the direction of the torque applied by the motor coupled to the motor controller. In some implementations, the jetfoiler can include two propellers that are mounted in-line and spinning counter clockwise and clockwise respectively to eliminate torque roll and to stabilize a board of the jetfoiler by speeding up and slowing down each of the two propellers.

Figure 17:
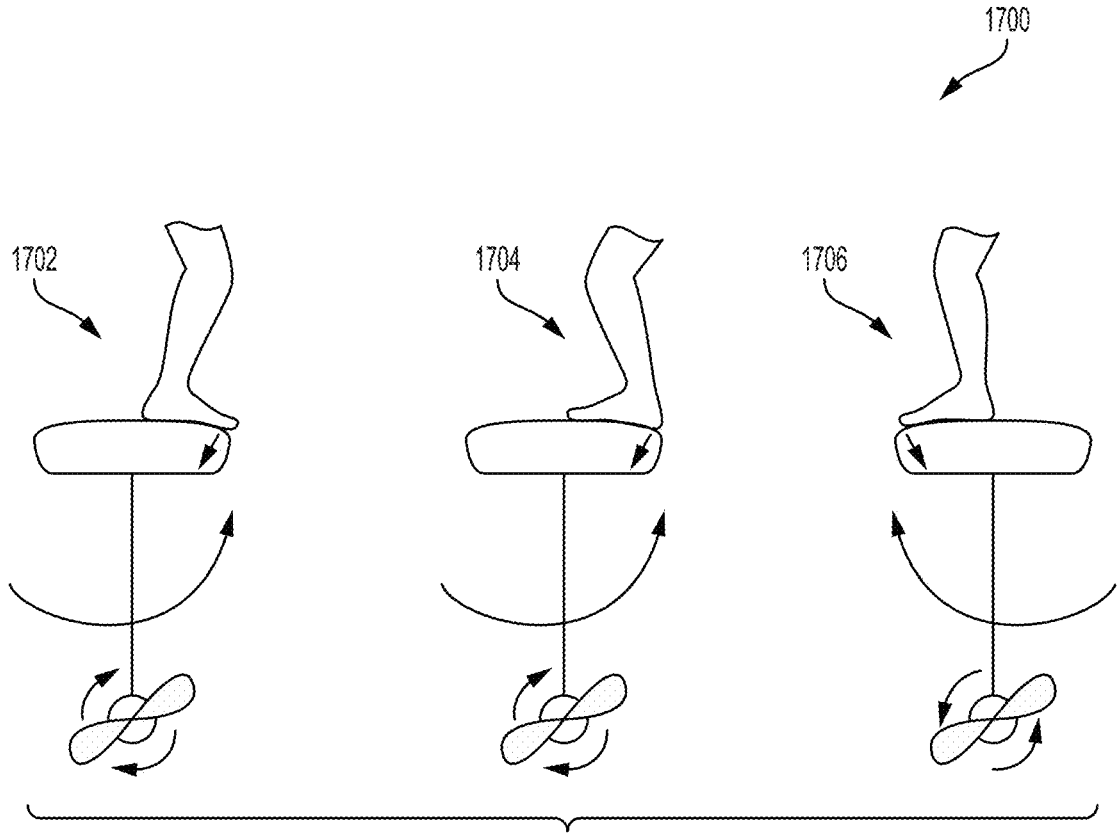
FIG. 17 illustrates an example of matching propeller spinning directions with rider stance during operation of a jetfoiler in accordance with implementations of the present disclosure.

FIG. 17 illustrates an example 1700 of matching propeller spinning directions with rider stance during operation of a jetfoiler in accordance with implementations of the present disclosure. The propeller spinning directions can be changed by changing a direction of the rotation of the propeller (e.g., the propeller 108 of FIG. 1 or the propeller 1602 of FIG. 16). Changing the propeller spinning directions to match rider style improves rider stance and ease of ride. The example 1700 includes a first matching 1702, a second matching 1704, and a third matching 1706 that each highlight various configurations between the propeller spinning direction and the rider stance. In the first matching 1702, a rider with a "regular" stance is correctly matched with a "regular" propeller spinning direction to provide ease of use. The propeller spinning direction of the first matching 1702 creates a force in one direction that is counterbalanced by a weighted force from the "regular" rider stance that positions the rider's feet towards an edge of a board of the jetfoiler.

In the second matching 1704, a rider with a "goofy" stance is incorrectly matched with a "regular" propeller spinning direction which may cause issues during the operation of the jetfoiler. The propeller spinning direction of the second matching 1704 creates a force in the same direction as aforementioned for the first matching 1702 but this force is not counterbalanced by a weighted force from the "goofy" rider stance that positions the rider's feet towards a center of the board. Therefore, the propeller spinning direction and the rider stance should be matched in accordance with the third matching 1706 that reverses a spinning direction of the propeller to counterbalance the weighted force from the "goofy" rider stance that positions the rider's feet towards an opposite edge of the board. Additional propeller spinning directions can be utilized by the jetfoiler to counterbalance different rider styles that are not categorized as "regular" or "goofy".

Figure 18:
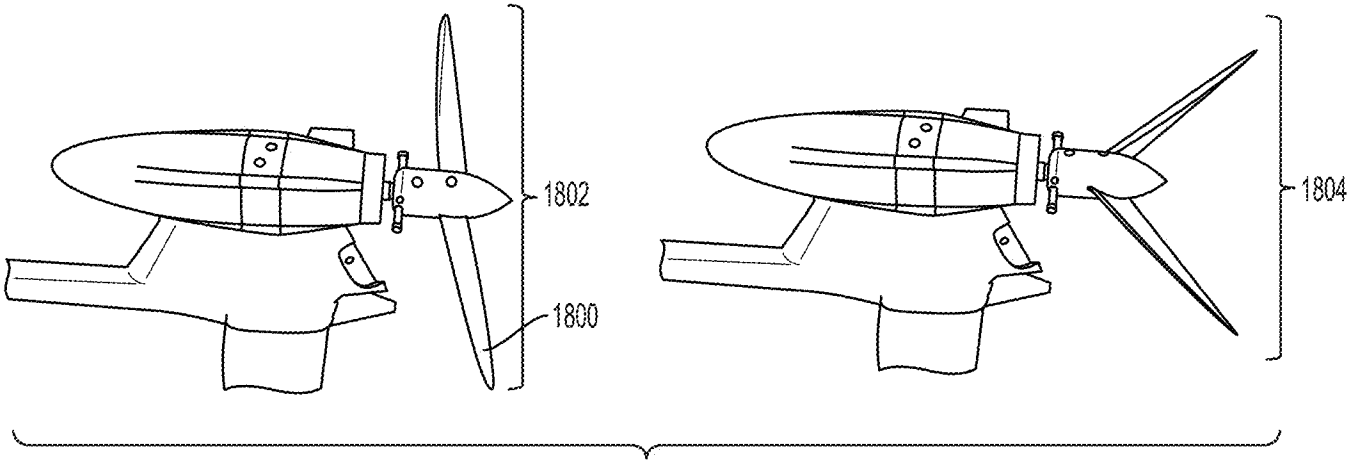
FIG. 18 illustrates an example of a folding propeller blades of propeller system of a jetfoiler in accordance with implementations of the present disclosure.

FIG. 18 illustrates an example of a folding propeller blades 1800 of a propeller system of a jetfoiler in accordance with implementations of the present disclosure. The folding propeller blades 1800 can be used to improve safety and reduce drag thereby prolonging battery life. The folding propeller blades 1800 are coupled to a propeller shaft that is coupled to a motor that is coupled to a propulsion pod (e.g., the propulsion pod 106 of FIG. 1 or the propulsion pod 1302 of FIG. 13) that is coupled to a hydrofoil (e.g., the hydrofoil 104 of FIG. 1) of the jetfoiler. The folding propeller blades 1800 comprise two or more propeller blades (e.g., the two or more propeller blades 1604 of FIG. 16). The folding propeller blades 1800 can be oriented in a first unfolded position 1802 and in a second folded position 1804. The folding propeller blades 1800 can be oriented in additional positions not shown (e.g., positions in between unfolded and folded, etc.). The folding propeller blades 1800 shift between the first unfolded position 1802 and the second folded position 1804 but the entire propeller system can also be shifted.

As the folding propeller blades 1800 shift from the first unfolded position 1802 (also referred to as a deployed position) to the second folded position 1804 (also referred to as a folded position) or vice versa, a stopping or blocking mechanism (e.g., blocks) can be used to lock the folding propeller blades 1800 in place. In addition, the folding propeller blades 1800 can be coupled to the propulsion pod using a pin to enable the rotation of the folding propeller blades 1800 between positions.

When the throttle is activated or engaged (e.g., via a throttle controller operated by the rider), the folding propeller blades 1800 start spinning and a first force or centrifugal force from the spinning outweighs a second force or force of the water on the folding propeller blades 1800 thereby allowing the folding propeller blades 1800 to deploy into the first unfolded position 1802. A first block is provided to stop the folding propeller blades 1800 from opening further than predetermined (e.g., to prevent damage) and the centrifugal force locks the folding propeller blades 1800 into place at the first unfolded position 1802. When the throttle is released, the force of the water outweighs the centrifugal force, and the folding propeller blades 1800 stops spinning which results in the folding propeller blades 1800 moving to the second folded position 1804 and being stopped once again by another or second block. Each blade of the folding propeller blades 1800 can rotate around a pin in an angled slot that guides the blades into a feathered position as they fold into the second folded position 1804.

The folding propeller blades 1800 can be used as a safety feature, to stop the folding propeller blades 1800 from spinning and then folding them into the second folded position 1804 when the throttle is not activated or engaged, which removes danger to riders and nearby swimmers. A folding propeller system in a folded position on the dock also improves safety and prevents the propeller system from being damaged (e.g., when there is no propeller guard). A folding propeller system can be used in wave riding where the rider may only occasionally want a power assist to reach the next wave. When not in use, the folding propeller blades 1800 can fold into the second folded position 1804 or similar folded positions to reduce drag and conserve battery.

The shifting of the various positions of the folding propeller can be manually carried out by the rider (e.g., by selecting an option on the display of the electronics unit within the board or the display on the throttle controller) based on operation requirements or can be automatically carried out by the jetfoiler using sensors and feedback mechanisms (e.g., machine learning mechanisms) and based on varying conditions. Therefore, the folding propeller blades 1800 can represent movable control surfaces (in addition to the adjustable flaps on the hydrofoil wings) of the jetfoiler that can automatically control the jetfoiler.

Figure 19:
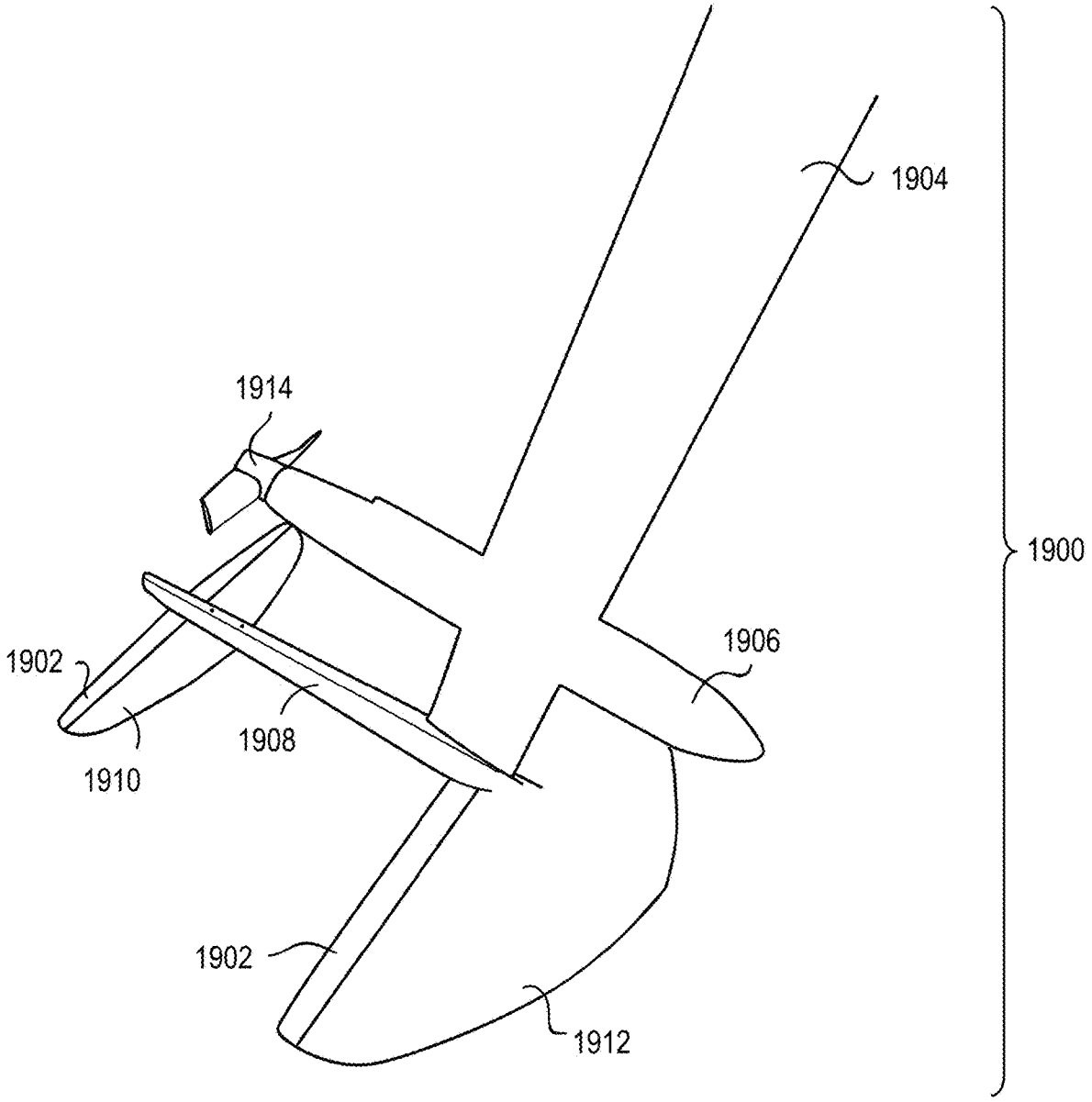
FIG. 19 illustrates an example of a hydrofoil of a jetfoiler that includes a moveable control surface in accordance with implementations of the present disclosure.

FIG. 19 illustrates an example of a hydrofoil 1900 of a jetfoiler that includes a moveable control surface 1902 in accordance with implementations of the present disclosure. The hydrofoil 1900 comprises a strut 1904, a propulsion pod 1906 coupled to the strut 1904, a fuselage 1908 coupled to the strut 1904, an aft wing 1910 coupled to the fuselage 1908, a forward wing 1912 coupled to the fuselage 1908, and a propeller 1914 coupled to the propulsion pod 1906. The aft wing 1910 includes a moveable control surface 1902. The forward wing 1912 also includes a moveable control surface 1902. Each moveable control surface 1902 can be a similar moveable control surface for both the aft wing 1910 and the forward wing 1912 or can be moveable control surfaces of varying types, shapes, or mechanisms. Each moveable control surface 1902 is operated using a pushrod mechanism (not shown) or a similar type of mechanism. The pushrod mechanism actuates each moveable control surface 1902 in response to feedback from any of a variety of sensors (e.g., a mechanical trailing wand, a ride height sensor) or in response to input from the operator (e.g., via the throttle controller), or in response to input from an automatic stabilization system (e.g., an IMU or a machine learning mechanism).

A jetfoiler in accordance with the present disclosure can be packed using a packaging material including but not limited to a flexible piece of foam which is durable and waterproof (e.g., expanded polypropylene) to safely pack the unusual shape of the jetfoiler. A C-shaped tube of foam can be cut to appropriate lengths and wrapped around hydrofoil, propulsion pod, and board components of the jetfoiler. Two pieces may be placed opposite each other to protect a circular shape such as the propulsion pod and can also be interchanged to provide easy storage of the packaging material (i.e., the foam pieces are stacked inside each other for storage or to ship the foam itself). The packaging can be used for general purpose shipping of other objects that are unusually sized and shaped.

A jetfoiler (e.g., the jetfoiler 100 of FIG. 1 or the jetfoiler 900 of FIG. 9) in accordance with the present disclosure can be operated using a variety of procedures or processes. In some implementations, a user (i.e., operator/rider) of the jetfoiler can get the jetfoiler ready for operation by first charging batteries in a battery sled and setting up a camera (e.g., a POV camera) within a propulsion pod of the jetfoiler. While the jetfoiler is on its side, with a hydrofoil of the jetfoiler and a board of the jetfoiler touching the ground or boat dock, the user can insert the battery sled into the propulsion pod via an opening (e.g., a forward opening). When pushed firmly or correctly into the propulsion pod, the battery sled can indicate its engagement with foil electronics by making a series of beeps or flashing lights. These steps are executed in a dry area.

The user can insert the camera into a nose cone of the propulsion pod if desired, by pulling a camera clip away from a camera window of the nose cone and snapping the camera into place behind the camera window. The user can reattach and lock the nose cone to the propulsion pod and can place the jetfoiler into the water with the hydrofoil going in first. The water should be deep enough to avoid contact between the hydrofoil and any surface such as rocks. The user can attach one end of a safety leash to his/her body (via his/her ankle) and can attach the other end that includes a magnet to the jetfoiler's fail/kill switch location.

The user can place his feet within footstraps (e.g., a back foot within a back strap and a front foot with a front strap or only one foot such as the back foot within a singular strap such as the back strap). The user can stabilize on the board and push a throttle controller of a throttle system gently to move clear of a launching platform (e.g., a boat, a dock). The user can accelerate by engaging the throttle controller. Once a forward speed of approximately 8-10 knots is achieved, a user can lift up the front foot and begin transitioning from non-foiling to foiling mode. The user can shift his/her weight forward as needed during transitioning into the foiling mode. The user can regulate speed by engaging or releasing the throttle controller. To stop, the user can ease completely off the throttle controller which transitions the jetfoiler back to non-foiling or displacement mode. The user fully releases the throttle controller and can glide back to the launching platform when finished operating or riding the jetfoiler.

In some implementations, when a throttle with a reverse feature is used, the user may stop more quickly or precisely by using the reverse feature to brake rather than gliding to a stop. When an inflatable board is used instead of a rigid board, the user can inflate the board before the ride and can attached the inflatable board to the hydrofoil power system (e.g., the hydrofoil power system 704 of FIG. 7A) using board-to-foil adapters. When the jetfoiler is configured with a smart throttle, the smart throttle limits power while the board is in contact with the water. After the user shifts weight as needed to initiate foiling (i.e., post-transition from non-foiling mode to foiling mode), the foiling can begin and a sensor can recognize the board as foiling thereby releasing the previous power limit set by the smart throttle. When a jetfoiler with a removable propulsion pod is used, the user can remove and charge the entire propulsion pod instead of removing just the batteries themselves from the propulsion pod.

In some implementations, when a folding propeller is used, the user can use the throttle to accelerate to catch a wave which can cause the folding propeller to deploy/unfold. When the user surfs on a wave or swell, using the power of the wave to propel forward, no motor assist is needed so the user can release the throttle while surfing to feather or retract the folding propeller to reduce drag. In the wave surfing mode, the folding propeller does not have to spin. When the user engages the throttle again for power assistance, the folding propeller can deploy. In an open ocean, this method of using the jetfoiler can allow the rider to cover a great distance while using less battery because the rider catches large rolling waves. To stop, the user can ease off the throttle and can transition back to non-foiling or displacement mode. When the user releases the throttle completely, the folding propeller can fold and the board glides to a stop.

A method and system in accordance with the present disclosure provides a watercraft device with a hydrofoil and electric-powered propeller. The watercraft device comprises a board, a throttle coupled to a top surface of the board or coupled wirelessly to the board, a hydrofoil coupled to a bottom surface of the board, and an electric propeller system coupled to the hydrofoil, wherein the electric propeller system powers the watercraft device using information generated from the throttle. In an implementation, the throttle can comprise an anchor point coupled to the top surface of the board, a cable coupled to the anchor point, and a throttle controller coupled to the cable, wherein the information is generated when an operator of the watercraft device engages the throttle controller. In another implementation, the throttle can comprise a handlebar coupled to the top surface of the board, wherein the handlebar is adjustable to a plurality of positions, and a throttle controlled coupled to the handlebar, wherein the information is generated when an operator of the watercraft device engages the throttle controller, further wherein the operator grips the handlebar for stability during operation. In another implementation, the throttle can comprise a wireless, handheld controller, which may also be attached to the operator, attached to a throttle cable, or attached to the handlebar.

The hydrofoil can comprise a strut coupled to the bottom surface of the board, a propulsion pod coupled to the strut, and at least two wings coupled to the propulsion pod. In some implementations, the hydrofoil includes only one wing. When the hydrofoil comprises the at least two wings, the at least two wings generate lift when the watercraft device is powered by the electric propeller system. The at least two wings can be coupled to a bottom surface of the propulsion pod so that the propulsion pod is above the at least two wings of the hydrofoil (i.e., the at least two wings is not integrated into or with the propulsion pod). The at least two wings can also be coupled to other areas of the propulsion pod including but not limited to a middle section in between the bottom surface and a top surface of the propulsion pod.

The hydrofoil can further comprise a rudder coupled to any of the strut and the propulsion pod (or another area of the jetfoiler) and at least one adjustable flap coupled to the aft or forward hydrofoil wings (or another area of the jetfoiler), which can be movable control structures that provide a stability system for the jetfoiler. The movable stability system automatically stabilizes the watercraft device using any of an operating speed, environmental conditions, jetfoiler ride height and pitch, and data associated with the operator. The feedback loop fed by jetfoiler ride height and pitch can include a plurality of sensors (e.g., IMU) and a plurality of algorithms (e.g., control system algorithms). The plurality of sensors can analyze the control of the jetfoiler and send associated data to the electronics unit that processes the data using the plurality of algorithms leading to adjustments in the movable control structures to stabilize the jetfoiler.

For example, the feedback mechanism can detect that the jetfoiler is too low and can automatically adjust the movable control structures to raise the jetfoiler. The gain or responsiveness of the control system can also be adjusted by the operator (e.g., set using a display or phone link to jetfoiler). The jetfoiler can include additional mechanisms (such as machine learning algorithms) that optimize the riding of the jetfoiler based on various detected conditions (e.g., detected using sensors of the jetfoiler). The assistance level requested by the control system may be based on the age, height, weight, stance, riding style, riding history, and skill level of the operator. The propulsion pod can comprise a nose cone that includes at least one camera, a body housing coupled to the nose cone, and a heat sink coupled to the body housing. The at least two wings can comprise an aft wing coupled to an aft area of the propulsion pod or hydrofoil fuselage, and a forward wing coupled to a forward area of the propulsion pod or hydrofoil fuselage, wherein the forward wing is larger than the aft wing. When the hydrofoil only includes one wing, the one wing can be either the aft wing, the forward wing, or a different type of wing located in a different location.

The electric propeller system can comprise a power system that includes an electric motor, a battery that powers the electric motor, and a propeller shaft driven by the electric motor, wherein the power system is housed within the body housing of the propulsion pod, and a propeller coupled to the power system via the propeller shaft, wherein the power system controls the propeller via the propeller shaft using the information generated by the throttle controller. The electric propeller system can further comprise a propeller guard coupled to the nose cone of the propulsion pod, wherein the propeller guard is positioned around the propeller.

The propeller can be a foldable propeller (or folding propeller) with a plurality of blades, further wherein the foldable propeller folds when the throttle controller is not engaged by the operator and the plurality of blades stop spinning. The watercraft device can further comprise an electronics unit housed within a first well or second well of the board, wherein the electronics unit receives the information from the throttle controller and processes the information to provide at least one command. The at least one command can be transmitted by the electronics unit to a motor controller of the power system to control the motor, which controls the propeller shaft, which controls the propeller.

The electronics unit can comprise a first microcontroller that receives the information from the throttle controller, processes the information to provide the at least one command, and transmits the at least one command to the motor controller of the power system, and a second microcontroller that logs additional information associated with operation of the watercraft device. The electronics unit can further comprise a display and a kill switch, wherein the kill switch is tethered to the operator via at least one footstrap or lanyard or leash for shutting down the watercraft device when the operator detaches from the watercraft device. The electronics unit receives the information from the throttle controller using any of a wired connection and a wireless connection.

A center of buoyancy in a non-foiling (or displacement) mode and a center of lift in a foiling mode are aligned. The non-foiling mode is when the board is in contact with a body of water during take-off of the watercraft device and the foiling mode is when the board is above a surface of the body of water during operation of the watercraft device. The center of buoyancy in the non-foiling mode and the center of lift in the foiling mode are aligned by aligning a center of an upward force generated by a buoyancy of the board when the jetfoiler is in the non-foiling mode with a center of an upward force from a lift generated by the at least two wings when the jetfoiler is in the foiling mode. The alignment can include shaping the board with a predetermined design that provides a center of buoyancy near or proximate or approximately close to a certain area or position of the board (i.e., a board position) and by positioning the hydrofoil that includes the at least two wings beneath the board proximate to the board position. The at least one footstrap that is coupled to the top surface of the board can also be positioned relative to the board position provided by the predetermined design of the board.

The board can comprise any of a carbon fiber material to provide a lightweight solid platform, a foam material with layers of fiberglass cloth and resin to provide a buoyant platform, a drop-stitch fabric material to provide an inflatable platform, and any combination thereof. The watercraft device can further include at least one wheel coupled to the top surface of the board.

While the disclosed technology has been described in connection with certain embodiments, it is to be understood that the disclosed technology is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A modular, weight-shift controlled watercraft device, comprising:

a modular board removably attached to a power system;

the power system including a modular power supply system, and a modular propulsion system;

the power supply system including a first battery;

the propulsion system including a modular strut, a modular propulsion pod, and a modular hydrofoil;

wherein the strut includes a first end and a second end, and includes a strut body disposed between the first end and second end;

wherein the board is removably attached to the first end of the strut;

wherein the hydrofoil is removably attached to the strut body at a first location;

wherein the propulsion pod is removably attached to the strut body at a second location interposed between the first end of the strut and the first location;

wherein the power supply system includes a first tray housing the first battery;

wherein the first tray is removably attachable directly to the first end of the strut;

wherein a first portion of the strut body is interposed between the first end of the strut and the propulsion pod; and wherein a second portion of the strut body is interposed between the propulsion pod and the hydrofoil.

2. The watercraft device of claim 1 wherein the power supply system is removably attachable directly to the strut of the propulsion system independent of any coupling to the board.

3. The watercraft device of claim 1:

wherein the power supply system includes a first tray housing the first battery;

wherein the first tray and the first battery are coupled to each other to form an integral modular unit; and wherein the integral modular unit is removably attachable directly to the first end of the strut.

4. The watercraft device of claim 1:

wherein the propulsion pod is removably attachable directly to the strut body; and wherein the hydrofoil is removably attachable directly to the strut body.

5. The watercraft device of claim 1:

wherein the power supply system is removably housed within a well of the board; and wherein the power supply system includes a top surface forming an upper surface portion of the board.

6. The watercraft device of claim 1 being configured or designed to enable an operator of the watercraft device to steer the watercraft device solely via weight-shift movements of the operator.

7. The watercraft device of claim 1 further comprising:

a wireless throttle controller, the throttle controller including a first input interface configured to receive input from an operator of the watercraft device, the throttle controller being configured to provide a first wireless control signal in response to first input received via the first input interface;

a drive system of the propulsion pod that includes an electric motor, a motor controller, a propeller, and a second input interface configured to receive at least one wireless control signal generated by the throttle controller; and wherein the drive system is configured to dynamically alter an output of the electric motor in response receiving at least one control signal generated by the throttle controller.

8. The watercraft device of claim 1 wherein the board is removably attachable to the propulsion system.

9. The watercraft device of claim 1 wherein the board is removably attachable to the strut.

10. The watercraft device of claim 1 wherein the board is removably attachable to the power supply system.

11. The watercraft device of claim 1 wherein the hydrofoil includes a fuselage and at least one wing attached to the fuselage, and wherein the fuselage is removably attached to the strut.

12. The watercraft device of claim 1 wherein the hydrofoil includes a fuselage and at least one wing attached to the fuselage, and wherein the fuselage is removably attached to the second end of the strut.

13. The watercraft device of claim 1:

wherein the first battery is electrically coupled to the propulsion pod via at least one electrical conduit;

wherein the propulsion pod includes an electric motor and a propeller physically attached to the electric motor;

wherein the power supply system includes a motor controller, the motor controller being electrically coupled to the electric motor via the at least one electrical conduit;

wherein the power supply system is removably housed within a well of the board; and wherein the power supply system includes a top surface forming an upper surface portion of the board.

14. The watercraft device of claim 1:

wherein the first battery is electrically coupled to the propulsion pod via at least one electrical conduit; and wherein the propulsion pod includes an electric motor, a motor controller electrically coupled to the electric motor, and a propeller physically attached to the electric motor.

15. The watercraft device of claim 1 further comprising:

a wireless throttle controller, the throttle controller including a first input interface configured to receive input from an operator of the watercraft device, the throttle controller being configured to provide a first wireless control signal in response to first input received via the first input interface;

a drive system of the propulsion pod that includes an electric motor, a motor controller, a foldable propeller, and a second input interface configured to receive at least one wireless control signal generated by the throttle controller; and wherein the foldable propeller is responsive to a second wireless control signal generated by the wireless throttle controller for causing the foldable propeller to be in an unfolded position, and wherein the foldable propeller is further responsive to a third wireless control signal generated by the wireless throttle controller for causing the foldable propeller to be in a folded position.

16. The watercraft device of claim 1 further comprising:

a ride height sensor system including a first water pressure sensor; and the ride height sensor system being configured or designed to determine a height of the board relative to a top surface of water in which the watercraft device is deployed.

17. The watercraft device of claim 1 further comprising:

a ride height sensor system including a first water pressure sensor;

the ride height sensor system being configured or designed to determine a depth of at least one component of the propulsion pod.

* * * * *